US010234783B2

(12) United States Patent
Sakata et al.

(10) Patent No.: US 10,234,783 B2
(45) Date of Patent: Mar. 19, 2019

(54) CARRIER, DEVELOPER, IMAGE FORMING APPARATUS, DEVELOPER STORED UNIT, AND IMAGE FORMING METHOD

(71) Applicants: Koichi Sakata, Shizuoka (JP); Tohru Suganuma, Shizuoka (JP); Shohichi Sugimoto, Shizuoka (JP); Hiroshi Tohmatsu, Shizuoka (JP); Hiroyuki Kishida, Shizuoka (JP); Kenichi Mashiko, Shizuoka (JP); Toyoaki Tano, Shizuoka (JP)

(72) Inventors: Koichi Sakata, Shizuoka (JP); Tohru Suganuma, Shizuoka (JP); Shohichi Sugimoto, Shizuoka (JP); Hiroshi Tohmatsu, Shizuoka (JP); Hiroyuki Kishida, Shizuoka (JP); Kenichi Mashiko, Shizuoka (JP); Toyoaki Tano, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/568,947

(22) PCT Filed: Apr. 28, 2016

(86) PCT No.: PCT/JP2016/002223
§ 371 (c)(1),
(2) Date: Oct. 24, 2017

(87) PCT Pub. No.: WO2016/181633
PCT Pub. Date: Nov. 17, 2016

(65) Prior Publication Data

US 2018/0120724 A1 May 3, 2018

(30) Foreign Application Priority Data

May 8, 2015 (JP) ..... 2015-095765

(51) Int. Cl.
*G03G 9/113* (2006.01)

(52) U.S. Cl.
CPC ..... *G03G 9/1139* (2013.01); *G03G 9/1136* (2013.01); *G03G 9/1137* (2013.01)

(58) Field of Classification Search
CPC ..... G03G 9/10; G03G 9/1133; G03G 9/1135; G03G 9/1137; G03G 9/1139
See application file for complete search history.

(56) References Cited

U.S. PATENT DOCUMENTS 5,652,079 A 7/1997 Mochizuki et al.
5,882,832 A 3/1999 Tosaka et al.
(Continued)

FOREIGN PATENT DOCUMENTS

JP 11-202560 7/1999
JP 2006-039357 2/2006
(Continued)

OTHER PUBLICATIONS

International Search Report and Written Opinion dated Jul. 19, 2016 for counterpart International Patent Application No. PCT/JP2016/002223 filed Apr. 28, 2016.
(Continued)

*Primary Examiner* — Peter L Vajda
(74) *Attorney, Agent, or Firm* — Oblon, McClelland, Maier & Neustadt, L.L.P.

(57) ABSTRACT

A carrier including a resin layer including at least one kind of particles, wherein the at least one kind of the particles are particles of barium sulfate, wherein an amount of Ba detected is 0.3 atomic % or greater in a Ba analysis through X-ray photoelectron spectroscopy (XPS) of the carrier, and wherein circle-equivalent diameters of the particles of the barium sulfate are 400 nm or greater but 900 nm or smaller.

12 Claims, 1 Drawing Sheet

(56) References Cited

U.S. PATENT DOCUMENTS

| | | | |
|---|---|---|---|
| 5,998,073 | A | 12/1999 | Kuramoto et al. |
| 6,268,098 | B1 | 7/2001 | Sugimoto et al. |
| 6,274,282 | B1 | 8/2001 | Sugimoto et al. |
| 6,319,646 | B1 | 11/2001 | Suganuma |
| 6,432,590 | B1 | 8/2002 | Ueda et al. |
| 7,169,525 | B2 | 1/2007 | Sugiura et al. |
| 7,172,844 | B2 | 2/2007 | Umemura et al. |
| 7,258,959 | B2 | 8/2007 | Nakayama et al. |
| 7,261,989 | B2 | 8/2007 | Sugiura et al. |
| 7,318,989 | B2 | 1/2008 | Kotsugai et al. |
| 7,374,851 | B2 | 5/2008 | Nakayama et al. |
| 7,455,942 | B2 | 11/2008 | Nagatomo et al. |
| 7,890,028 | B2 | 2/2011 | Miyamoto et al. |
| 8,084,176 | B2 | 12/2011 | Iwamoto et al. |
| 8,431,312 | B2 | 4/2013 | Masuda et al. |
| 8,521,073 | B2 | 8/2013 | Kubo et al. |
| 8,546,055 | B2 | 10/2013 | Nakayama et al. |
| 8,760,717 | B2 | 6/2014 | Kubo et al. |
| 8,934,821 | B2 | 1/2015 | Kubo et al. |
| 9,063,475 | B2 | 6/2015 | Aoto et al. |
| 9,223,256 | B2 | 12/2015 | Katoh et al. |
| 2002/0192580 | A1 | 12/2002 | Kuramoto et al. |
| 2003/0190538 | A1 | 10/2003 | Kuramoto et al. |
| 2005/0026064 | A1 | 2/2005 | Sugiura et al. |
| 2005/0089786 | A1 | 4/2005 | Sugiura et al. |
| 2005/0089787 | A1 | 4/2005 | Uchinokura et al. |
| 2005/0158648 | A1 | 7/2005 | Making et al. |
| 2005/0191575 | A1 | 9/2005 | Sugiura et al. |
| 2005/0208408 | A1 | 9/2005 | Uchinokura et al. |
| 2005/0208411 | A1 | 9/2005 | Nakayama et al. |
| 2006/0024606 | A1 | 2/2006 | Suzuki et al. |
| 2006/0029433 | A1 | 2/2006 | Saito et al. |
| 2006/0032952 | A1 | 2/2006 | Kawamoto et al. |
| 2007/0190444 | A1 | 8/2007 | Kotsugai et al. |
| 2007/0275318 | A1 | 11/2007 | Sugiura et al. |
| 2008/0014527 | A1 | 1/2008 | Kotsugai et al. |
| 2008/0181670 | A1 | 7/2008 | Tsuda et al. |
| 2008/0227021 | A1 | 9/2008 | Suganuma |
| 2008/0267668 | A1 | 10/2008 | Sakata et al. |
| 2008/0268366 | A1 | 10/2008 | Nakayama et al. |
| 2008/0317508 | A1 | 12/2008 | Terai et al. |
| 2009/0074473 | A1 | 3/2009 | Takahashi et al. |
| 2009/0103943 | A1 | 4/2009 | Sakata |
| 2009/0214966 | A1 | 8/2009 | Kishida |
| 2009/0232532 | A1 | 9/2009 | Sakata et al. |
| 2010/0067958 | A1 | 3/2010 | Kishida et al. |
| 2010/0068644 | A1 | 3/2010 | Nakajima et al. |
| 2010/0068645 | A1 | 3/2010 | Iwatsuki et al. |
| 2010/0136471 | A1 | 6/2010 | Yamada et al. |
| 2010/0233613 | A1 | 9/2010 | Masuda et al. |
| 2010/0239975 | A1 | 9/2010 | Yamaguchi et al. |
| 2011/0042856 | A1 | 2/2011 | Aoto et al. |
| 2011/0065037 | A1 | 3/2011 | Iwatsuki et al. |
| 2011/0086307 | A1* | 4/2011 | Nakajima ..... G03G 9/10 430/111.3 |
| 2011/0091802 | A1 | 4/2011 | Takahashi et al. |
| 2011/0170915 | A1 | 7/2011 | Aoki et al. |
| 2011/0171573 | A1* | 7/2011 | Sakata ..... G03G 9/10 430/111.1 |
| 2011/0177238 | A1 | 7/2011 | Aoto et al. |
| 2011/0229817 | A1 | 9/2011 | Yamada et al. |
| 2012/0028183 | A1 | 2/2012 | Nakajima et al. |
| 2012/0057898 | A1 | 3/2012 | Sakata et al. |
| 2012/0058423 | A1 | 3/2012 | Yamaguchi et al. |
| 2012/0064451 | A1 | 3/2012 | Kishida et al. |
| 2012/0201578 | A1 | 8/2012 | Mashiko et al. |
| 2012/0230725 | A1 | 9/2012 | Sakata et al. |
| 2013/0004209 | A1 | 1/2013 | Kishida et al. |
| 2013/0004212 | A1 | 1/2013 | Kubo et al. |
| 2013/0016999 | A1 | 1/2013 | Tohmatsu et al. |
| 2013/0065171 | A1 | 3/2013 | Yaguchi et al. |
| 2013/0065175 | A1 | 3/2013 | Sakata et al. |
| 2013/0101930 | A1 | 4/2013 | Yamaguchi et al. |
| 2013/0252169 | A1 | 9/2013 | Yaguchi et al. |
| 2013/0334014 | A1 | 12/2013 | Mashiko et al. |
| 2014/0072910 | A1 | 3/2014 | Iwatsuki et al. |
| 2014/0080052 | A1 | 3/2014 | Yaguchi et al. |
| 2014/0227638 | A1 | 8/2014 | Kishida et al. |
| 2014/0248557 | A1 | 9/2014 | Yaguchi et al. |
| 2014/0348552 | A1 | 11/2014 | Iwatsuki et al. |
| 2015/0153665 | A1 | 6/2015 | Kishida et al. |

FOREIGN PATENT DOCUMENTS

| | | |
|---|---|---|
| JP | 2006-079022 | 3/2006 |
| JP | 2010-117519 | 5/2010 |
| JP | 2011-145388 | 7/2011 |
| JP | 2011-209678 | 10/2011 |
| JP | 2013-064856 | 4/2013 |
| JP | 5534409 | 5/2014 |
| JP | 5626569 | 10/2014 |
| JP | 2014-215484 | 11/2014 |

OTHER PUBLICATIONS

Written Opinion dated Jul. 19, 2016 for counterpart International Patent Application No. PCT/JP2016/002223 filed Apr. 28, 2016.
U.S. Appl. No. 09/127,971, filed Aug. 4, 1998.
U.S. Appl. No. 09/377,935, filed Aug. 20, 1999.

* cited by examiner

[Fig. 1]
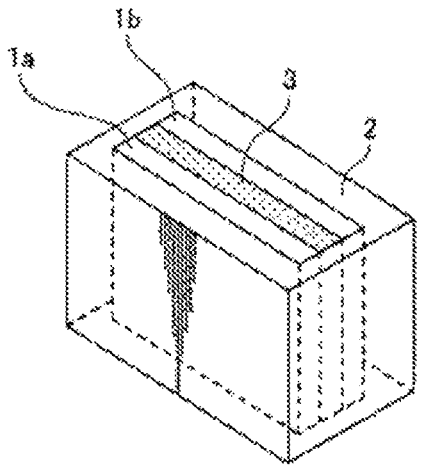
[Fig. 2]
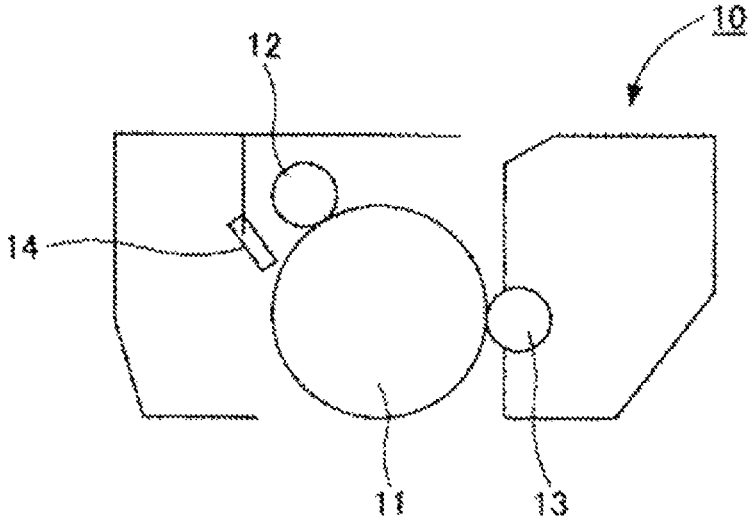

CARRIER, DEVELOPER, IMAGE FORMING APPARATUS, DEVELOPER STORED UNIT, AND IMAGE FORMING METHOD

TECHNICAL FIELD

The present disclosure relates to carriers for image formation, and developers containing the carriers.

BACKGROUND ART

In image formation according to an electrophotography system, an electrostatic latent image is formed on an electrostatic latent image bearer formed of, for example, a photoconductive material, a charged toner is deposited on the electrostatic latent image to form a toner image, the toner image is transferred onto a recording medium, followed by fixing, to thereby output an image. Recently, a technology related to photocopiers or printers using the electrophotographic system has been rapidly sifted from monochrome image formation to full-color image formation. A market for full-color image formation is expected to spread even more.

For the purpose of downsizing a fixing device for use, and simplifying a structure thereof, a toner containing a release agent is used in full-color image formation, similar to monochrome image formation. Therefore, an oilless system, where an oil is not applied to a fixing roller, tends to be employed. In full-color image formation, however, it is necessary to reduce a viscoelasticity of a melted toner in order to make a surface of a fixed toner image smooth. Therefore, offset tends to occur more easily than in a case of formation of a monochrome image having no gloss, and it is difficult to employ an oilless system in full-color image formation. When a toner containing a release agent is used in full-color image formation, moreover, adhesion of the toner increases to lower transferring properties of the toner to a recording medium. In addition, filming of the toner occurs to lower chargeability of a developer, to thereby decrease durability of the developer.

Regarding a carrier, meanwhile, a known carrier has a resin containing carbon black formed on a surface as a coating layer. Such a carrier is used for the purposes of preventing filming of a toner, forming a uniform surface of a fixed image, preventing oxidization of the surface, preventing reduction in moisture sensitivity, extending a service life of a developer, preventing deposition of a toner on a surface of a photoconductor, protecting a photoconductor from scratches or abrasion, controlling a polarity of charging, and adjusting a charged amount of a developer. Although excellent images can be formed using the aforementioned carrier at an initial stage, there is a problem that an image quality decreases due to peeling of a coating layer of the carrier, as the number of sheets copied increases. Moreover, there is a problem that color staining occurs because the coating layer is peeled off from the carrier, or carbon black is fallen off from the coating layer. In general, titanium oxide and zinc oxide are known as alternative materials of carbon black, but these materials demonstrate an insufficient effect of lowering volume resistivity.

PTL 1 discloses a carrier to which a coating layer containing antimony-doped tin oxide (ATO) as a needle-shaped conductive powder is formed. PTL 2 discloses a carrier to which a coating layer containing conductive particles is formed, and each conductive particle contains a base particle, and a tin dioxide layer and an indium oxide layer containing tin dioxide laminated on a surface of the base particle. PTL 3 discloses a carrier having a coating layer containing first conductive particles that are conductive particles of a metal oxide, and second conductive particles that are at least one of metal oxide particles and metal salt particles, where surfaces of the metal oxide particles and metal salt particles have been subjected to a conduction treatment.

Moreover, PTL 4 discloses a carrier having a coating layer containing barium sulfate. PTL 5 discloses a carrier having a coating layer containing a resin formed of a certain copolymer, and barium sulfate. Furthermore, PTL 6 and PTL 7 disclose carriers each having a coating layer, and disclose that a Ba/Si ratio is from 0.01 through 0.08 when the carriers are measured by X-ray photoelectron spectroscopy (XPS). Furthermore, PTL 8 discloses a carrier where barium sulfate is used as a base of conductive particles contained in the carrier.

CITATION LIST

Patent Literature

PTL 1: Japanese Unexamined Patent Application Publication No. 11-202560

PTL 2: Japanese Unexamined Patent Application Publication No. 2006-39357

PTL 3: Japanese Unexamined Patent Application Publication No. 2010-117519

PTL 4: Japanese Unexamined Patent Application Publication No. 2011-145388

PTL 5: Japanese Patent No. 5626569

PTL 6: Japanese Patent No. 5534409

PTL 7: Japanese Unexamined Patent Application Publication No. 2011-209678

PTL 8: Japanese Unexamined Patent Application Publication No. 2006-079022

SUMMARY OF INVENTION

Technical Problem

PTL 1 has a problem that color staining occurs similar to the case of carbon black because a color tone of ATO is tinted with blue. PTL 2 has a problem that production cost is high because the conductive particles contain a rare metal, and the carrier cannot be sustainably used. The carrier disclosed in PTL 3 has a certain effect against a reduction in chargeability of the carrier, but the chargeability decreases when a toner including a large amount of external additives is used and continuous output of images with large imaging areas is performed, and hence a charging effect of the disclosed carrier is not sufficient.

Moreover, the carriers disclosed in PTL 4 through PTL 8 have certain effects to reduction in chargeability of the carriers when a toner is repeatedly consumed and supplied for outputting images with large imaging areas. In recent years, toners tend to be designed to achieve low-temperature fixing in order to reduce energy consumption, and there is also a demand for increasing printing speeds. Under the aforementioned circumstance, a toner spent, which is a phenomenon that a toner film is formed on surfaces of carrier particles, is more easily caused. To meet a demand for high image quality, moreover, toners tend to contain a large amount of additives. These additives are spent on the carrier to decrease a charged amount of the toner and to cause toner scattering and background fog. Moreover, there have been attempts to reduce amounts of charged particles and the like in toners in order to realize low-temperature fixing of toners. Therefore, there is a problem that a supplied toner is not sufficiently blended into a developer, and therefore the toner is not sufficiently charged to thereby cause toner scattering. The carrier disclosed in PTL 4 through PTL 8 does not have a sufficient effect against the aforementioned new problems.

Meanwhile, even higher image quality is required in a recently expanding commercial printing market, that is, a production printing field. It is technically very difficult to deal with a concentration variation or concentration unevenness within an image on one sheet, or a concentration variation between images printed on some ten thousands sheets only with a body of a machine. Therefore, there is an even stronger need for controlling a charged amount of a toner to be constant. However, the carrier disclosed in the aforementioned patent literatures cannot satisfy the aforementioned needs.

The present invention has an object to provide a carrier used in a developer that is used for an electrophotographic method or an electrostatic latent recording method, which can sufficiently control charges to achieve an image quality required in a production printing field, can supply a stable amount of the developer to a developing region, and can realize continuous output of images of a low imaging area ratio with a high-speed device using a low-temperature fixing toner.

Solution to Problem

Means for solving the aforementioned problems are as follows. Specifically, a carrier of the present invention includes a resin layer including at least one kind of particles.

The at least one kind of the particles are particles of barium sulfate. An amount of Ba detected is 0.3 atomic % or greater in a Ba analysis through X-ray photoelectron spectroscopy (XPS) of the carrier. Moreover, circle-equivalent diameters of the particles of the barium sulfate are 400 nm or greater but 900 nm or smaller.

Advantageous Effects of Invention

The present invention can provide a carrier used in a developer that is used for an electrophotographic method or an electrostatic latent recording method, which can sufficiently control charge to achieve an image quality required in a production printing field, can supply a stable amount of the developer to a developing region, and continuous output of images with a low imaging area ratio can be realized with a high-speed device using a low-temperature fixing toner.

BRIEF DESCRIPTION OF DRAWINGS

FIG. 1 is a view illustrating a cell used when volume resistivity of the carrier of the present invention is measured.

FIG. 2 is a view illustrating one example of a process cartridge for use in the present invention.

DESCRIPTION OF EMBODIMENTS (Carrier)

A carrier of the present invention includes a resin layer. The carrier of the present invention preferably contains a core, and the resin layer coating the core.

The resin layer contains at least one kind of particles. In the present invention, the at least one kind of the particles includes particles of barium sulfate.

In a Ba analysis through X-ray photoelectron spectroscopy (XPS) of the carrier of the present invention, an amount of Ba detected is 0.3 atomic % or greater.

Moreover, circle-equivalent diameters of the particles of the barium sulfate are 400 nm or greater but 900 nm or smaller.

The carrier of the present invention satisfying the aforementioned conditions can sufficiently control charging to obtain a desired image quality, can stably supply a certain amount of a developer to a developing region, and enables continuous feeding of sheets at a printing density of a low imaging area ratio in a high-speed device utilizing a low-temperature fixing toner.

In the present invention, at least the particles of the barium sulfate are contained in the resin layer, and the amount of Ba detected of the surface of the resin layer is 0.3 atomic % or greater in XPS. The barium sulfate can enhance chargeability of a toner, and the barium sulfate present in the surface layer can maintain chargeability even after outputting images of large imaging areas over a long period. In addition, the circle-equivalent diameters of the particles of the barium sulfate are 400 nm or greater but 900 nm or smaller. When the particle diameters of the particles of the barium sulfate are within the aforementioned range, the particles of the barium sulfate can be projected from the resin layer of the carrier. Inside a developing device, stress is always applied to the surface of the carrier, to which the projected areas are formed with the particles of the barium sulfate, by friction with a toner, a carrier, and a developing screw. Therefore, even when the toner resin, wax, or additives are temporarily spent thereon, the spent film will be immediately scraped by the aforementioned stress. Accordingly, the barium sulfate can be maintained in an exposed state all the time.

Meanwhile, the toner resin, wax, or additives are spent on recess areas present between the projected areas of the barium sulfate. The carrier has electrically the same charge as that of the toner by being covered with the spent film, and therefore, the spent matter is not accumulated any further. The recess areas formed with the spent matter in the surface layer of the carrier cannot charge a toner and have a low probability of friction with the toner because the areas are recessed, and as a result contribution to charging of the toner is small. Accordingly, the parts where the barium sulfate forms the projected area determine chargeability of the carrier, and therefore stable chargeability can be ensured over a long period.

Moreover, irregularities can be formed on a surface layer of the carrier, when the particle diameters of the particles of the barium sulfate are within the aforementioned range. As a result, bulk density of the carrier becomes stable. Typically, the bulk density of the carrier changes due to scraped surfaces of carrier particles, or spent of a toner component on surface layers of carrier particles. As a result, an amount of the developer taken up on a developing sleeve changes to change an amount of the developer supplied to a developing region, to thereby vary a developing performance. When the particles of the barium sulfate having circle-equivalent diameters of 400 nm or greater but 900 nm or smaller are contained in the resin layer, however, an effect of minimizing a variation of the bulk density of the carrier can be obtained because the spent matter is accumulated in recess areas. In addition, a film strength of the resin layer can be increased by dispersing the particles of the barium sulfate in the resin layer. Therefore, an amount of the scraped resin layer can be reduced. As a result, a variation in the bulk density of the carrier is hardly caused by spent or scraping of the resin layer, and a stable developing performance can be ensured over a long period.

<Resin Layer>

The resin layer includes a resin and the particles of the barium sulfate. Other than the particles of the barium sulfate, the resin layer may include various conductive particles. The resin layer may include a silane coupling agent in order to improve stability and durability of the carrier over time.

The resin layer is preferably free from film defects, and has an average film thickness of from 0.80 μm through 1.50 μm. When an average film thickness of the resin layer is 0.80 μm or greater, the particles of the barium sulfate can be sufficiently retained in the resin layer, and can be prevented from being fallen off from the resin layer. When an average film thickness of the resin layer is 1.50 μm or less, it is possible to prevent a problem that sufficient charging ability cannot be exhibited because the particles of the barium sulfate are completely embedded inside the resin layer.

<<Particles of Barium Sulfate>>

For the aforementioned reasons, the circle-equivalent diameters of the particles of the barium sulfate are 400 nm or greater but 900 nm or smaller. In order to ensure a stable charging capability and developing performance, however, the circle-equivalent diameters are more preferably 600 nm or greater. When the circle-equivalent diameter of the particles of the barium sulfate are 900 nm or greater, the size of the particles of the barium sulfate becomes too large relative to a film thickness of the resin layer, and the particles of the barium sulfate tend to fall off from the resin layer. Accordingly, the circle-equivalent diameters of the particles of the barium sulfate are 900 nm or smaller.

The particles of the barium sulfate are not particularly limited, as long as Ba is present at surfaces of the particles. The particles of the barium sulfate are included in the resin layer in a state where Ba is present at surfaces of the particles. As described above, the barium sulfate exposed from a surface layer of the carrier contributes to impartment of stable chargeability. When surface layers of the particles of the barium sulfate are covered with a material, such as tin, the barium sulfate is not exposed from the surface layers of the particles, and hence sufficient chargeability cannot be ensured. Accordingly, it is difficult to exhibit stable chargeability. An effect of easily making a supplied toner be incorporated into a developer is obtained by exposing the barium sulfate from the surface layers of the particles. It is assumed that the aforementioned effect is obtained owing to the fact that the barium sulfate easily charges a toner through frictions. Therefore, such a carrier is particularly effective for a toner, in which the number of charged particles is reduced for low-temperature fixing. In the present specification, the phrase "Bo is present at surfaces of the particles" means that the barium sulfate is not covered with a material such as tin, and the barium sulfate occupies 90% or greater of a surface of the particle. The particles of the barium sulfate may be particles formed of only barium sulfate.

An amount of the particles of the barium sulfate is 50% by mass or greater but less than 100% by mass relative to the resin contained in the resin layer.

When the amount of the particles is 50% by mass or greater, it is possible to prevent a problem that a toner cannot be sufficiently charged because the exposed areas of the barium sulfate are not enough. When the amount of the particles is less than 100% by mass, it is possible to prevent a problem that it is difficult to adjust initial charge because chargeability of the carrier is too high.

<<Resin>>

The resin is not particularly limited and may be appropriately selected depending on the intended purpose. Examples of the resins include resins obtained by heating a copolymer containing at least the following two monomer component A (also referred as component A) and monomer component B (also referred to as component B).

[Chem. 1]

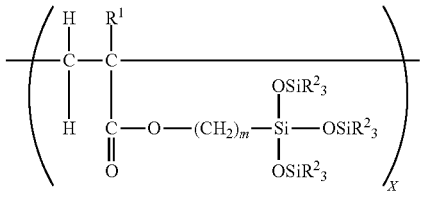

Component A

[Chem. 2]

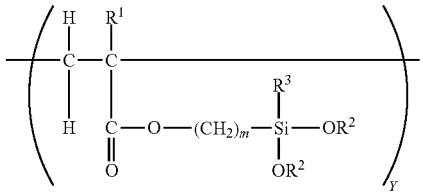

Component B (cross-linking component)

(In the formulae above, $R^1$, m, $R^2$, $R^3$, X, and Y are as follows.)

$R^1$ is a hydrogen atom or a methyl group.

m is an integer of from 1 through 8, accordingly $(CH_2)_m$ is an alkylene group having from 1 through 8 carbon atoms, such as a methylene group, an ethylene group, a propylene group, and a butylene group.

$R^2$ is an alkyl group having from 1 through 4 carbon atoms, such as a methyl group, an ethyl group, a propyl group, an isopropyl group, and a butyl group.

$R^3$ is an alkyl group having from 1 through 8 carbon atoms (e.g., a methyl group, an ethyl group, a propyl group, an isopropyl group, and a butyl group), or an alkoxy group from 1 through 4 carbon atoms (e.g., a methoxy group, an ethoxy group, a propoxy group, and a butoxy group).

X is from 10 mol % through 90 mol %, more preferably from 30 mol % through 70 mol %.

Y is from 10 mol % through 90 mol %, more preferably from 30 mol % through 70 mol %.

The component A includes at a side chain thereof tris (trimethylsiloxy)silane, which is an atomic group where many methyl groups are present. When a proportion of the component A is high relative to the entire resin, a surface energy of each carrier particle becomes small. As a result, a less amount of a resin component or wax component of a toner is deposited on the carrier. When the proportion of the component A is 10 mol % or greater, a sufficient effect can be obtained, and an increase in an amount of the toner component deposited on the carrier particle can be prevented. When the proportion of the component A is 90 mol % or less, it is possible to prevent the following problem raised as a result of decrease in the proportions of the component B and the component C: i.e., cross-linking reaction does not progress to fail to obtain sufficient toughness of a resin layer, as well as decrease adhesion between the core and the resin layer to impair durability of the resin layer of the carrier.

$R^2$ is an alkyl group having from 1 through 4 carbon atoms. Examples of the component A include tris(trialkylsiloxy)silane compounds represented by the following formulae.

In the formulae below, Me is a methyl group, Et is an ethyl group, and Pr is a propyl group.

$CH_2{=}CMe{-}COO{-}C_3H_6{-}Si(OSiMe_3)_3$ $CH_2{=}CH{-}COO{-}C_3H_6{-}Si(OSiMe_3)_3$ $CH_2{=}CMe{-}COO{-}C_4H_8{-}Si(OSiMe_3)_3$ $CH_2{=}CMe{-}COO{-}C_3H_6{-}Si(OSiEt_3)_3$ $CH_2{=}CH{-}COO{-}C_3H_6{-}Si(OSiEt_3)_3$ $CH_2{=}CMe{-}COO{-}C_4H_8{-}Si(OSiEt_3)_3$ $CH_2{=}CMe{-}COO{-}C_3H_6{-}Si(OSiPr_3)_3$ $CH_2{=}CH{-}COO{-}C_3H_6{-}Si(OSiPr_3)_3$ $CH_2{=}CMe{-}COO{-}C_4H_8{-}Si(OSiPr_3)_3$

A production method of the component A is not particularly limited. The component A can be obtained by a method where tris(trialkylsiloxy)silane is allowed to react with allyl acrylate or allyl methacrylate in the presence of a platinum catalyst, or by a method where methacryloxyalkyl trialkoxysilane and hexaalkyl disiloxane are allowed to react in the presence of carboxylic acid and an acid catalyst, as described in Japanese Unexamined Patent Application Publication No. 11-217389.

The component B is a radically polymerizable bifunctional (a case where $R^3$ is an alkyl group) or trifunctional (a case where $R^3$ is also an alkoxy group) silane compound. When a proportion of the component B is 10 mol % or greater, sufficient toughness of a resin layer can be obtained. When the proportion of the component B is 90 mol % or less, it is possible to prevent a problem that a resin layer becomes hard and brittle and the resin layer is easily cracked. Moreover, a deterioration in environmental properties can be prevented. This is because the environmental properties (humidity dependency) are assumed to be deteriorated when a large number of the hydrolyzed cross-linked component remain as silanol groups.

Examples of the aforementioned component B include 3-methacryloxypropyltrimethoxysilane, 3-acryloxypropyltrimethoxysilane, 3-methacryloxypropyltriethoxysilane, 3-acryloxypropyltriethoxysilane, 3-methacryloxypropylmethyldimethoxysilane, 3-methacryloxypropylmethyldiethoxysilane, 3-methacryloxypropyltri(isopropoxy)silane, and 3-acryloxypropyltri(isopropoxy)silane.

In the present invention, the resin layer is preferably formed by coating cores with a cross-linked product, followed by performing a heat treatment. The cross-linked product is obtained by performing hydrolysis of the following copolymer to generate silanol groups and condensing using a catalyst. The copolymer is obtained by performing radical copolymerization of the monomer component A and the monomer component B.

[Chem. 3]

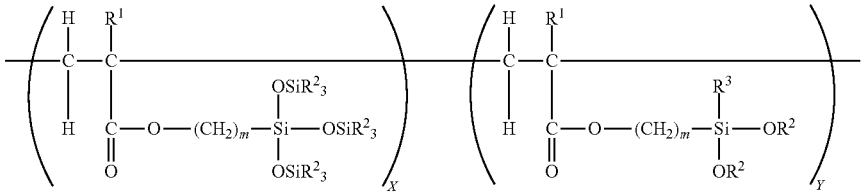

In the formula above, $R^1$, m, $R^2$, $R^3$, X, and Y are as described above.

In the present invention, moreover, an acrylic compound (monomer) may be added as component C to the component A and the component B.

Examples of the copolymer to which the monomer component C (also referred to as component C) has been added include the following copolymer.

[Chem. 4]

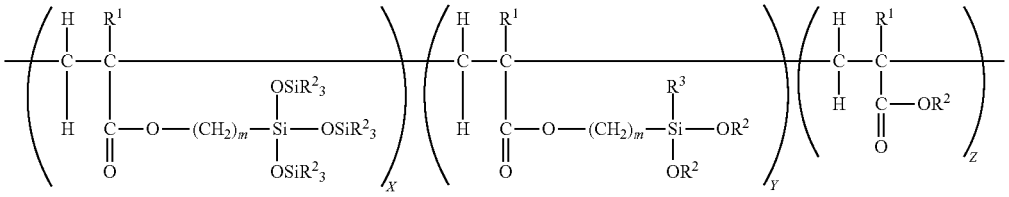

In the formula above, $R^1$, m, $R^2$, and $R^3$ are as described above. In the copolymer above, X is from 10 mol % through 40 mol %, Y is from 10 mol % through 40 mol %, Z is from 30 mol % through 80 mol %, and Y and Z satisfies the relationship: 60 mol %<Y+Z<90 mol %.

The component C is represented by the following formula. In the formula below, $R^1$ and $R^2$ are as described above.

[Chem. 5]

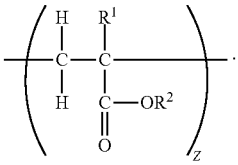

The component C is a component for imparting flexibility to the resin layer to improve adhesion between the core and the resin layer. When a proportion of the component C is 30 mol % or greater, sufficient adhesion can be obtained. When the proportion of the component C is 80 mol % or less, either the component A or the component B cannot be 10 mol % or less, to thereby achieve all of water proof properties, hardness, and flexibility (no film cracking) of the coating of the carrier particle.

As for the acrylic compound (monomer) of the component C, acrylic acid ester, and methacrylic acid ester are preferable. Specific examples thereof include methyl methacrylate, methyl acrylate, ethyl methacrylate, ethyl acrylate, butyl methacrylate, butyl acrylate, 2-(dimethylamino)ethyl methacrylate, 2-(dimethylamino)ethyl acrylate, 3-(dimethylamino)propyl methacrylate, and 3-(dimethylamino)propyl acrylate.

Among the above-listed examples, alkyl methacrylate is more preferable, and methyl methacrylate is particularly preferable. Moreover, one of the above-listed compounds may be used alone, or two or more of the above-listed compounds may be used in combination.

A technology for increasing durability of a resin layer through cross-linking is described in, for example, Japanese Patent No. 3691115. Japanese Patent No. 3691115 discloses a carrier for developing an electrostatic latent image, the carrier including magnetic particles and a thermosetting resin covering each magnetic particle, where the thermosetting resin is prepared by cross-linking a copolymer of organopolysiloxane containing a vinyl group at a terminal thereof, and a radially polymerizable monomer containing at least one functional group selected from the group consisting of a hydroxyl group, an amino group, an amide group, and an imide group, using an isocyanate compound. According to the disclosed technology, the resin layer is peeled or scraped and hence it cannot be said that sufficient durability of the carrier is obtained. Although a reason for the aforementioned insufficient durability is not clear, in case of the aforementioned thermosetting resin obtained by cross-linking the copolymer with the isocyanate compound, the number of functional groups (active hydrogen-containing groups, such as an amino group, a hydroxyl group, a carboxyl group, and a mercapto group) per unit weight is small as seen from the structural formula. The functional groups are reactive (cross-linkable) with the isocyanate compound in the copolymer resin. It is therefore assumed that a dense two-dimensional or three-dimensional cross-linked structure cannot be formed at cross-linking points. When such a toner is used over a long period, a coating film tends to be peeled or scraped (low abrasion resistance of the resin layer), and sufficient durability is not obtained.

When the resin layer is peeled or scraped, resistance of the carrier decreases to cause a change in image quality, and carrier deposition. Moreover, the peeling or scraping of the resin layer deceases flowability of a developer to reduce an amount of the developer taken up, causing low image density, background fog due to an increased toner density (TC), and toner scattering.

Meanwhile, the resin layer of the present invention formed with the aforementioned resin is very tough and is not easily scraped, and achieves high durability, because the resin layer is formed using a copolymer resin having a larger number (twice or three times larger per unit weight) of bifunctional or trifunctional cross-linkable functional groups (points) per unit weight of the resin, and is formed by cross-linking the copolymer resin through condensation polymerization.

Moreover, the cross-linkage with siloxane bonds used in the present invention has larger bonding energy and is more stable to heat stress than cross-linkage with the isocyanate compound. Therefore, it is assumed that the resin layer for use in the present invention can ensure stability over time.

As described above, a preferable embodiment is to form a resin layer by a method including hydrolyzing the copolymer to generate silanol groups and condensation-polymerizing the silanol groups. Examples of a catalyst used for the condensation polymerization include titanium-based catalysts, tin-based catalysts, zirconium-based catalysts, and aluminium-based catalysts.

In the present invention, the titanium-based catalysts are preferably used among the above-listed catalysts, and titanium diisopropoxybis(ethylacetoacetate) is particularly preferably used. These catalysts have a large effect of accelerating condensation reaction of silanol groups, and are not easily deactivated.

In addition to the aforementioned resin, a silicone resin, an acrylic resin, or a combination thereof can be used as a resin for forming the resin layer. The acrylic resin has high adhesion and low brittleness, and thus has excellent abrasion stability. On the other hand, the acrylic resin has high surface energy, and therefore use of the acrylic resin in combination with a toner that easily causes toner spent may cause a problem, such as a low charged amount due to accumulation of the toner component spent. In this case, the aforementioned problem can be solved by using the silicone resin in combination. The silicone resin has low surface energy, and therefore a toner component is hardly spent thereon. In addition, the silicone resin exhibits an effect of suppressing accumulation of the spent component, because scraping of the silicone resin film is caused. On the other hand, the silicone resin has poor abrasion resistance, because the silicone resin has weak adhesion and high brittleness. When the acrylic resin and the silicone resin are used in combination, therefore, a balance of both the resins is considered to form a resin layer that causes toner spent hardly, and has abrasion resistance.

The silicone resin means any of generally known silicone resins. Examples of the silicone resin include straight silicone composed only of organosiloxane bonds, and silicone resins modified with alkyd, polyester, epoxy, acryl, or urethane. Examples of commercially available products of the straight silicone resin include: KR271, KR255, and KR152 available from Shin-Etsu Chemical Co., Ltd.; and SR2400, SR2406, and SR2410 available from Dow Corning Toray Co., Ltd. In this case, the silicone resin may be used alone, but the silicone resin may be used together with other components that perform cross-linking reaction, or components for adjusting a charged amount of a resultant carrier. Moreover, examples of commercially available products of the modified silicone resin include: KR206 (alkyd-modified), KR5208 (acryl-modified), ES1001N (epoxy-modified), and KR305 (urethane-modified) available from Shin-Etsu Chemical Co., Ltd.; and SR2115 (epoxy-modified) and SR2110 (alkyd-modified) available from Dow Corning Toray Co., Ltd.

Examples of a formation method of the resin layer include the following method.

The resin layer can be formed with a resin layer composition, which contains, as well as the copolymer and the particles of the barium sulfate, a silicone resin containing at least one of a silanol group and a hydrolysis functional group, a catalyst, and optionally contains a resin other than the above silicone resin, and a solvent. Specifically, the resin layer may be formed by condensing the silanol groups with covering cores with the resin layer composition, or may be formed by condensing the silanol groups after covering the cores with the resin layer composition. The method for condensing the silanol groups with covering the core particles with the resin layer composition is not particularly limited, but examples of such a method include a method including covering cores with the resin layer composition with applying heat or light. Moreover, the method for condensing the silanol groups after covering the cores with the resin layer composition is not particularly limited, but examples of such a method include a method including heating after covering the cores with the resin layer composition.

<<Other Components>>

In addition to the aforementioned resin, and the aforementioned particles of the barium sulfate, the components constituting the resin layer include other components, such as conductive particles and a silane coupling agent. The resin layer may contain conductive particles for the purpose of adjusting the volume resistivity of the carrier.

The conductive particles are not particularly limited, and examples thereof include carbon black, ITO, PTO, WTO, tin oxide, zinc oxide, and conductive polymers (e.g., polyaniline) The above-listed particles may be used in combination.

The resin layer may contain a silane coupling agent for the purpose of stably dispersing the particles.

The silane coupling agent is not particularly limited, and examples thereof include gamma-(2-aminoethyl)aminopropyltrimethoxysilane, gamma-(2-aminoethyl)aminopropylmethyldimethoxysilane, gamma-methacryloxypropyltrimethoxysilane, N-beta-(N-vinylbenzylaminoethyl)-gamma-aminopropyltrimethoxysilane hydrochloride, gamma-glycidoxypropyltrimethoxysilane, gamma-mercaptopropyltrimethoxysilane, methyltrimethoxysilane, methyltriethoxysilane, vinyltriacetoxysilane, gamma-chloropropyltrimethoxysilane, hexamethyldisilazane, gamma-anilinopropyltrimethoxysilane, vinyl trimethoxysilane, octade-cyldimethyl[3-(trimethoxysilyl)propyl]ammonium chloride, gamma-chloropropylmethyldimethoxysilane, methyltrichlorosilane, dimethyldichlorosilane, trimethylchlorosilane, allylethoxysilane, 3-aminopropylmethyldiethoxysilane, 3-aminopropyltrimethoxysilane, dimethyldiethoxysilane, 1,3-divinyltetramethyldisilazane, and methacry-loxyethyldimethyl(3-trimethoxysilylpropyl)ammonium chloride. The above-listed silane coupling agents may be used in combination.

Examples of commercially available products of the silane coupling agent include AY43-059, SR6020, SZ6023, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920, and Z-6940 (all available from Dow Corning Toray Co., Ltd.).

An amount of the silane coupling agent is preferably from 0.1% by mass through 10% by mass relative to the resin. When the amount of the silane coupling agent is 0.1% by mass or greater, it is possible to prevent a problem that the resin layer is fallen off during use over a long period as a result of reduction in the adhesion between the core or conductive particles and the resin. When the amount of the silane coupling agent is 10% by mass or less, it is possible to prevent filming of a toner which may be caused during use over a long period.

<Cores>

The cores are not particularly limited as long as that the cores are composed of a magnetic material. Examples of the cores include: ferromagnetic metals such as iron and cobalt; iron oxide, such as magnetite, hematite, and ferrite; various alloys and compounds; resin particles containing any of the above-listed magnetic materials dispersed in a resin. Among the above-listed examples, Mn-based ferrite, Mn/Mg-based ferrite, and Mn—Mg—Sr ferrite are preferable in view of environmental friendliness.

<Properties of Carrier>

In the Ba analysis of the X-ray photoelectron spectroscopy (XPS) of the carrier of the present invention, the amount of Ba detected is 0.3 atomic % or greater, as described above.

The amount of Ba detected is more preferably from 0.3 atomic % through 2.0 atomic %, even more preferably from 0.3 atomic % through 1.5 atomic %.

In the carrier of the present invention, a height d of a projected part, which is the barium sulfate exposed from a surface of the resin layer of the carrier, is 200 nm or greater.

As described above, the surface of the barium sulfate constituting the projected part largely contributes to charging. When the height of the projected part is low, however, the barium sulfate is embedded in a toner component spent on the carrier particle, to decrease chargeability of the carrier. Therefore, such a carrier cannot stably exhibit chargeability. Accordingly, the height d of the projected part in the maximum exposed area of the barium sulfate in the carrier is 200 nm or greater.

In the carrier of the present invention, moreover, a major axis of a maximum exposed area among exposed areas of the barium sulfate exposed from a surface of the resin layer of the carrier is 300 nm or greater.

As described above, the surface of the barium sulfate constituting a projected part largely contributes to charging. When an area of the projected part is small, however, a contact probability with a toner decreases, and such a carrier cannot sufficiently charge a toner. Accordingly, the major axis of the maximum exposed area of the barium sulfate is 300 nm or greater.

The carrier of the present invention has a volume average particle diameter which is 28 μm or greater but 40 μm or smaller. When the volume average particle diameter of the carrier particles is 28 μm or greater, carrier deposition can be prevented. When the volume average particle diameter thereof is 40 μm or smaller, reduction in reproducibility of a detailed area of an image can be prevented, and precise image formation can be realized.

The carrier of the present invention has a volume resistivity of from 8 (Log Ωcm) through 16 (Log Ωcm). When the volume resistivity of the carrier is 8 (Log Ωcm) or greater, carrier deposition on a non-imaging area can be prevented. When the volume resistivity of the carrier is 16 (Log Ωcm) or less, an edge effect can be secured.

<Measuring Methods of Various Properties of Carrier>

The aforementioned properties of the carrier can be measured by the following methods.

<<Ba Analysis Through X-Ray Photoelectron Spectroscopy (XPS)>>

An amount of Ba detected on a surface of the carrier can be measured by AXIS/ULYRA (available from Shimadzu Corporation/Kratos Analytical Ltd.).

A beam radiation range is an approximate size of 900 μm×600 μm, and a range of 25 carrier particles×17 carrier particles is detected. Moreover, a penetration depth is in a range of from 0 nm through 10 nm, and states of areas adjacent surfaces of carrier particles can be measured.

Specific measuring conditions are as follows.

Measuring mode: Al: 1486.6 eV

Excitation source: monochrome (Al)

Detection system: spectrum mode

Magnet lens: OFF

The detected elements are then determined by wide scanning Subsequently, a peak is detected per detected element by narrow scanning Thereafter, Ba (atomic %) in all of the detected elements is calculated using an attached peak analysis software.

<<Measuring Method of Circle-Equivalent Diameter>>

Circle-equivalent diameters of the particles of the barium sulfate are measured in the following method.

The carrier is mixed with an embedding resin (two-liquid, 30 min-curable epoxy resin, available from ITW Devcon Inc.), and the mixture is left to stand overnight to cure the resin. A rough cross-section sample is produced by mechanical polishing. The cross-section of the sample is finished by means of a cross-section polisher (SM-09010, available from JEOL Ltd.) at an accelerating voltage of 5.0 kV and a beam current of 120 μA. An image of the resultant sample is taken by a scanning electron microscope (Merlin, available from Carl Zeiss) at an accelerating voltage of 0.8 kV, with a magnification of 30,000 times. The taken image is converted into a TIFF image file, and circle-equivalent diameters of 100 particles of the barium sulfate are measured by means of Image-Pro Plus available from Media Cybernetics Inc. An average value of the measured values is determined.

<<Measuring Method of Height D Of Projected Part of Exposed Barium Sulfate>>

A height d of a projected part in the maximum exposed area of the barium sulfate is measured by the following method.

Specifically, the carrier is mixed with an embedding resin (two-liquid, 30 min-curable epoxy resin, available from ITW Devcon Inc.), and the mixture is left to stand overnight to cure the resin. A rough cross-section sample is produced by mechanical polishing. The cross-section of the sample is finished by means of a cross section polisher (SM-09010, available from JEOL Ltd.) at an accelerating voltage of 5.0 kV and a beam current of 120 μA. An image of the resultant sample is taken by a scanning electron microscope (Merlin, available from Carl Zeiss) at an accelerating voltage of 0.8 kV, with a magnification of 10,000 times and 30,000 times. Each of the taken images is converted into a TIFF image file, and an average film thickness of the resin layers of 100 carrier particles is calculated. Moreover, a height d of a projected part in the maximum area among exposed areas of the barium sulfate in one carrier particle is determined, and a difference between the height d and the average film thickness is calculated. The aforementioned measurement is performed on 100 carrier particles, and an average value of the measured values is determined as a height d of a projected part of the exposed barium sulfate.

<<Measuring Method of Major Axis of Maximum Exposed Area of Barium Sulfate>>

The major axis of the maximum exposed area of the barium sulfate is measured by the following method. A backscattered electron image is taken by means of an electron microscope S-4200, available from Hitachi Ltd., at an applied voltage of 1 KV, with a magnification of 1,000 times. The backscattered electron image is converted into a TIFF image file, and is formed into an image only with particles using Image-Pro Plus available from Media Cybernetics Inc. Thereafter, the resultant image is subjected to binarization to divide the image into white areas (areas of the exposed barium sulfate) and black areas (areas covered with the resin), and major axes of the white areas are measured. The major axis of the longest value within one carrier particle is determined as a major axis of the maximum exposed area in the carrier particle. The aforementioned measurement is performed on 100 carrier particles, and an average value of the measured values is taken as a major axis of the maximum exposed area of the barium sulfate.

<<Measuring Method of Volume Average Particle Diameter of Carrier>>

For example, the volume average particle diameter of the carrier can be measured by means of Microtrack, a particle size distribution analyzer, Model HRA9320-X100 (available from NIKKISO CO., LTD.).

<<Measuring Method of Volume Resistivity of Carrier>>

The volume resistivity of the carrier can be measured using a cell illustrated in FIG. 1. First, a cell of a fluororesin container (2) is charged with the carrier (3). In the fluororesin container (2), an electrode (1*a*) and an electrode (1*b*), each of which has a surface area of 2.5 cm×4 cm, are placed so as to be apart from each other with a distance of 0.2 cm. Tapping of the cell is performed 10 times at a fall height of 1 cm and a tapping speed of 30 times/min. Subsequently, DC voltage of 1,000 V is applied between the electrodes (1*a*) and (1*b*). Thirty seconds later, a resistance value [Ω] is measured by means of a high resistance meter 4329A (available from Agilent Technologies Inc.), and volume resistivity [Ωcm] can be calculated from the following formula.

$$r\times(2.5\times4)/0.2 \qquad \text{[Math.1]}$$

The volume resistivity (Log Ωcm) of the carrier is a common logarithm value of the volume resistivity [Ωcm] obtained by the aforementioned measurement.

(Developer)

A developer of the present invention includes at least the carrier and a toner. The developer may further contain other components.

<Toner>

A toner includes at least a binder resin and a colorant. The toner may be a monochrome toner or a color toner. Moreover, the toner may include a release agent for applying the toner to an oilless system, where no oil for preventing toner adhesion is applied to a fixing roller. In general, a toner tends to cause filming. The developer of the present invention however can maintain high quality over a long period, because the carrier of the present invention can prevent filming.

In general, a color toner, especially a yellow toner, has a problem that color staining occurs due to scraping of coating layers of carrier particles. The developer of the present invention can prevent occurrences of color staining because the carrier of the present invention has high durability.

The toner may include a charge controlling agent, external additives, a flowability improving agent, a cleaning improving agent, and a magnetic material.

The toner can be produced by a typical method, such as a pulverizing method, and a polymerization method. In the case where the toner is produced by the pulverizing method, for example, first, a toner material is kneaded to obtain a melt-kneaded product, the melt-kneaded product is cooled, and then the cooled product is pulverized, followed by classification, to thereby produce base particles. In order to further improve transferring performance and durability of a resultant toner, external additives are subsequently added to the base particles to thereby produce a toner.

The binder resin is not particularly limited. Examples of the binder resin include: homopolymers of styrenes and substituted products of styrenes, such as polystyrene, poly (p-styrene), and polyvinyl toluene; styrene-based copolymers, such as styrene-p-chlorostyrene copolymers, styrene-propylene copolymers, styrene-vinyl toluene copolymers, styrene-methyl acrylate copolymers, styrene-ethyl acrylate copolymers, styrene-methacrylic acid copolymers, styrene-methyl methacrylate copolymers, styrene-ethyl methacrylate copolymers, styrene-butyl methacrylate copolymers, styrene-methyl alpha-chloromethacrylate copolymers, styrene-acrylonitrile copolymers, styrene-vinyl methyl ether copolymers, styrene-vinyl methyl ketone copolymers, styrene-butadiene copolymers, styrene-isoprene copolymers, and styrene-maleic acid ester copolymers; polymethyl methacrylate; polybutyl methacrylate; polyvinyl chloride; polyvinyl acetate; polyethylene; polyesters; polyurethane; epoxy resins; polyvinyl butyral; polyacrylic acid; rosins; modified rosins; terpene resins; phenol resins; aliphatic or aromatic hydrocarbon resins; and aromatic petroleum resins. The above-listed examples may be used in combination.

A binder resin for pressure fixing is not particularly limited. Examples of such a binder resin include: polyolefin, such as low-molecular-weight polyethylene and low-molecular-weight polypropylene; olefin copolymers, such as ethylene-acrylic acid copolymers, ethylene-acrylic acid ester copolymers, styrene-methacrylic acid copolymers, ethylene-methacrylic acid ester copolymers, ethylene-vinyl chloride copolymers, ethylene-vinyl acetate copolymers, and ionomer resins; epoxy resins; polyesters; styrene-butadiene copolymers; polyvinyl pyrrolidone; methyl vinyl ether-maleic anhydride copolymers; maleic acid-modified phenol resins; and phenol-modified terpene resins. The above-listed examples may be used in combination.

The colorant (a pigment or a dye) is not particularly limited. Examples of the colorant include: yellow pigments, such as cadmium yellow, mineral fast yellow, nickel titanium yellow, Naples yellow, Naphthol Yellow S, Hansa Yellow G, Hansa Yellow 10G, Benzidine Yellow GR, quinoline yellow lake, Permanent Yellow NCG, and tartrazine lake; orange pigments, such as molybdate orange, Permanent Orange GTR, pyrazolone orange, Vulcan orange, Indanthrene Brilliant Orange RK, benzidine orange G, and Indanthrene Brilliant Orange GK; red pigments, such as red iron oxide, cadmium red, Permanent Red 4R, lithol red, pyrazolone red, watching red calcium salt, Lake Red D, Brilliant Carmine 6B, eosin lake, Rhodamine Lake B, alizarin lake, and Brilliant Carmine 3B; purple pigments, such as Fast Violet B, and methyl violet lake; blue pigments, such as cobalt blue, alkali blue, Victoria blue lake, phthalocyanine blue, metal-free phthalocyanine blue, partially chlorinated phthalocyanine blue, fast sky blue, and Indanthrene Blue BC; green pigments, such as chrome green, chromium oxide, Pigment Green B, and malachite green lake; and black pigments, such as carbon black, oil furnace black, channel black, lamp black, acetylene black, azine dyes (e.g., aniline black), metal salts of azo dyes, metal oxides, and composite metal oxides. The above-listed colorants may be used in combination.

The release agent is not particularly limited. Examples of the release agent include polyolefin (e.g., polyethylene and polypropylene), metal salts of fatty acids, fatty acid esters, paraffin wax, amide wax, polyvalent alcohol wax, silicone varnish, carnauba wax, and ester wax. The above-listed release agents may be used in combination.

Images of desired image quality can be stably obtained over an extremely long period, when a supply developer contains the carrier of the present invention and a toner, and the supply developer is used in an image forming apparatus, which performs image formation with discharging an excess developer in a developing device. Specifically, the developer of the present invention can stably maintain a charged amount over a long period to contribute to stable formation of images in the image forming apparatus, in which the deteriorated carrier in the developing device is replaced with a carrier that has not been deteriorated. The aforementioned effects are obtained especially in an image forming system for printing images of large imaging areas. When images of large imaging areas are formed, a carrier is deteriorated mainly due to toner spent on the carrier. Use of the carrier of the present invention however can prevent toner spent, and adverse influences from scraping of resin layers of carrier particles.

When the developer is used as a supply developer, a blending ratio of the carrier and the toner in the developer is preferably that the toner is from 2 parts by mass through 50 parts by mass relative to 1 part by mass of the carrier. When the amount of the toner is 2 parts by mass or greater, an amount of the supplied carrier is not excessively large, and it is possible to prevent an increase in a charged amount of the developer caused as a result of an increase in a carrier concentration in a developing device. In addition, it is also possible to prevent a problem that a developing performance is lowered to decrease image density of a resultant image as a result of an increase in a charged amount of the developer. When the amount of the toner is 50 parts by mass or smaller, it is possible to prevent reduction in the ratio of the carrier in the supply developer, and also prevent a problem that the carrier is deteriorated because a replacement amount of the carrier is small in an image forming apparatus.

(Image Forming Apparatus and Image Forming Method)

An image forming apparatus of the present invention includes an electrostatic latent image bearer, an electrostatic latent image forming unit, and a developing unit. The image forming apparatus may further include other units, if necessary. Examples of the other units include a transfer unit, a fixing unit, a cleaning unit, a charge eliminating unit, a recycling unit, and a controlling unit.

The image forming method of the present invention include an electrostatic latent image forming step and a developing step. The image forming method may further include other steps, if necessary. Examples of the other steps include a transfer step, a fixing step, a cleaning step, a charge eliminating step, a recycling step, and a controlling step.

The image forming method of the present invention can be suitably performed by the image forming apparatus of the present invention.

More specifically, the image forming apparatus of the present invention includes an electrostatic latent image bearer, an electrostatic latent image forming unit configured to form an electrostatic latent image on the electrostatic latent image bearer, and a developing unit containing a toner and configured to develop the electrostatic latent image formed on the electrostatic latent image bearer with the developer to form a toner image.

The electrostatic latent image forming unit may include a charging unit configured to charge the electrostatic latent image bearer, and an exposing unit configured to expose a surface of the electrostatic latent image bearer to light imagewise.

Moreover, the image forming apparatus of the present invention may further include a transfer unit configured to transfer the toner image formed on the electrostatic latent image bearer onto a recording medium, a fixing unit configured to fix the toner image transferred onto the recording medium, and a cleaning unit configured to clean the electrostatic latent image bearer.

Moreover, the developing unit may be any of various developer stored units, as long as the developer stored unit includes therein the developer of the present invention.

The developer stored unit of the present invention includes a unit having a function of storing the developer, and the developer stored in the unit.

Embodiments of the developer stored unit include a developer container, a developing device, and a process cartridge.

The developer container refers to a container containing a developer in the container.

The developing device refers to that including a unit storing a developer and configured to perform development.

The process cartridge refers to an integrated unit of at least an electrostatic latent image bearer and a developing unit including the developer of the present invention, and is detachably mounted in an image forming apparatus. Moreover, the integrated unit of the process cartridge may include the electrostatic latent image bearer, the developing unit, and at least one selected from the group consisting of a charging unit, an exposing unit, and a cleaning unit.

FIG. 2 illustrates one example of the process cartridge of the present invention. The process cartridge (10) includes a photoconductor (11), a charging device (12) configured to charge the photoconductor (11), a developing device (13) configured to develop an electrostatic latent image formed on the photoconductor (11) with the developer of the present invention to form a toner image, and a cleaning device (14) configured to remove the toner remaining on the photoconductor (11) after transfer of the toner image formed on the photoconductor (11) onto a recording medium, and the aforementioned units are supported as an integrated unit. The process cartridge (10) is detachably mounted in a body of an image forming apparatus, such as photocopiers and printers.

Hereinafter, a method for forming an image using an image forming apparatus equipped with the process cartridge (10) is described. First, the photoconductor (11) is driven to rotate at a predetermined rim speed, and a peripheral surface of the photoconductor (11) is uniformly charged with a predetermined positive or negative potential by means of the charging device (12). Next, exposure light is applied to the peripheral surface of the photoconductor (11) from an exposing device (not illustrated), such as an exposing device of a slit exposure system, and an exposing device configured to perform scanning exposure with laser beams, to thereby form an electrostatic latent image. The electrostatic latent image formed on the peripheral surface of the photoconductor (11) is developed with the developer of the present invention by means of the developing device (13) to thereby form a toner image. Subsequently, the toner image formed on the peripheral surface of the photoconductor (11) is transferred onto transfer paper fed between the photoconductor (11) and a transfer device (not illustrated) from a paper feeding unit (not illustrated) in synchronization with the rotation of the photoconductor (11). Moreover, the transfer paper, onto which the toner image has been transferred, is separated from the peripheral surface of the photoconductor (11), and is guided into a fixing device (not illustrated) to perform fixing. Thereafter, the paper is output as a print (photocopy) from the image forming apparatus. Meanwhile, the toner remaining on the surface of the photoconductor (11), from which the toner image has been transferred, is removed by the cleaning device (14) to clean the photoconductor (11). Thereafter, the surface of the photoconductor (11) is subjected to a charge elimination process by means of a charge eliminating device (not illustrated), to thereby be ready for a next image forming process.

EXAMPLES

The present invention will be described in more detail by way of Examples and Comparative Examples. However, the present invention should not be construed as being limited to the Examples. Note that, the unit "part(s)" means "part(s) by mass".

Resin Synthesis Example 1

A flask equipped with a stirrer was charged with 300 g of toluene, followed by heating to 90° C. under a flow of nitrogen gas. To the toluene, subsequently, a mixture containing 84.4 g (200 mmol) of 3-methacryloxypropyltris (trimethylsiloxy)silane (Silaplane TM-0701T, available from CHISSO CORPORATION) represented by $CH_2{=}CMe{-}COO{-}C_3H_6{-}Si(OSiMe_3)_3$ (where Me is a methyl group), 39 g (150 mmol) of 3-methacryloxypropylmethyldiethoxysilane, 65.0 g (650 mmol) of methyl methacrylate, and 0.58 g (3 mmol) of 2,2'-azobis-2-methylbutyronitrile was added dropwise over 1 hour. After completion of the addition of the mixture, a solution containing 0.06 g (0.3 mmol) of 2,2'-azobis-2-methylbutyronitrile dissolved in 15 g of toluene was added to the aforementioned mixture (a total amount of 2,2'-azobis-2-methylbutyronitrile: 0.64 g (3.3 mmol)), and the resultant mixture was stirred for 3 hours at a temperature of from 90° C. through 100° C. to perform radical copolymerization, to thereby obtain Methacryl-Based Copolymer R1.

Carrier Production Example 1

Twenty parts (solid content: 100% by mass) of the methacryl-based copolymer obtained in Synthesis Example 1, the methacryl-based copolymer having a weight average molecular weight of 35,000, 100 parts (solid content: 20% by mass) of a solution of a silicone resin (SR2410, available from Dow Corning Toray Co., Ltd.), 3.0 parts (solid content: 100% by mass) of aminosilane, 36 parts of barium sulfate particles (available from SAKAI CHEMICAL INDUSTRY CO., LTD., circle-equivalent diameter: 700 nm) as particles, and 60 parts of oxygen-deficient tin particles (available from MITSUI MINING & SMELTING CO., LTD., primary particle diameter: 30 nm) as particles, and 2 parts of titanium diisopropoxybis(ethylacetoacetate) (TC-750, available from Matsumoto Fine Chemical Co., Ltd.) serving as a catalyst were diluted with toluene to thereby obtain a resin solution having a solid content of 20% by mass. Mn ferrite particles having a weight average particle diameter of 35 μm were used as core particles. The aforementioned resin solution was applied onto a surface of each core particle by means of a fluidized bed coating device using an atomizer nozzle. The resin solution was applied in a manner that an average film thickness of a resin layer would be 1.00 μm. The application of the resin solution by coating, and drying of the applied film were performed in the fluidized bed, a temperature of which was controlled to 60° C. The obtained carrier was burned in an electric furnace for 1 hour at 210° C., to thereby obtain Carrier 1.

The obtained Carrier 1 was subjected to evaluations of various properties in accordance with the aforementioned measuring methods. The measurement results are presented in the following Table 1-1 (measurement results of Carriers 2 to 17 described below are also presented in Tables 1-1 to 1-3). In Tables 1-1 to 1-3, P-doped Sn means oxygen-deficient tin particles, R1 means Methacryl-Based Copolymer R1, and Si means a silicone resin.

Carrier Production Example 2

Carrier 2 of Carrier Production Example 2 was obtained in the same manner as in Carrier Production Example 1, expect that the circle-equivalent diameter of the barium sulfate particles was changed to 900 nm.

Carrier Production Example 3

Carrier 3 of Carrier Production Example 3 was obtained in the same manner as in Carrier Production Example 1, expect that the circle-equivalent diameter of the barium sulfate particles was changed to 400 nm.

Carrier Production Example 4

Carrier 4 of Carrier Production Example 4 was obtained in the same manner as in Carrier Production Example 1, expect that the circle-equivalent diameter of the barium sulfate particles was changed to 600 nm.

Carrier Production Example 5

Carrier 5 of Carrier Production Example 5 was obtained in the same manner as in Carrier Production Example 1, expect that the amount of the barium sulfate particles was changed to 20 parts by mass.

Carrier Production Example 6

Carrier 6 of Carrier Production Example 6 was obtained in the same manner as in Carrier Production Example 1, expect that the amount of the barium sulfate particles was changed to 40 parts by mass.

Carrier Production Example 7

Carrier 7 of Carrier Production Example 7 was obtained in the same manner as in Carrier Production Example 1, expect that the amount of the barium sulfate particles was changed to 16 parts by mass.

Carrier Production Example 8

Carrier 8 of Carrier Production Example 8 was obtained in the same manner as in Carrier Production Example 4, expect that the amount of the barium sulfate particles was changed to 20 parts by mass.

Carrier Production Example 9

Carrier 9 of Carrier Production Example 9 was obtained in the same manner as in Carrier Production Example 1, expect that the methacryl-based copolymer was not used, and the amount of the silicone resin solution was changed to 200 parts by mass.

Carrier Production Example 10

Carrier 10 of Carrier Production Example 10 was obtained in the same manner as in Carrier Production Example 1, expect that the average film thickness of the resin layer applied on a surface of the core was changed to 0.70 μm.

Carrier Production Example 11

Carrier 11 of Carrier Production Example 11 was obtained in the same manner as in Carrier Production Example 1, expect that the average film thickness of the resin layer disposed on a surface of the core was changed to 1.30 μm.

Carrier Production Example 12

Carrier 12 of Carrier Production Example 12 was obtained in the same manner as in Carrier Production Example 1, expect that the average film thickness of the resin layer disposed on a surface of the core was changed to 1.60 μm.

Carrier Production Example 13

Carrier 13 of Carrier Production Example 13 was obtained in the same manner as in Carrier Production Example 1, expect that the oxygen-deficient tin particles were not used.

Carrier Production Comparative Example 1

Carrier 14 of Carrier Production Comparative Example 1 was obtained in the same manner as in Carrier Production Example 1, expect that the circle-equivalent diameter of the barium sulfate particles was changed to 1,000 nm.

Carrier Production Comparative Example 2

Carrier 15 of Carrier Production Comparative Example 2 was obtained in the same manner as in Carrier Production Example 1, expect that the circle-equivalent diameter of the barium sulfate particles was changed to 300 nm.

Carrier Production Comparative Example 3

Carrier 16 of Carrier Production Comparative Example 3 was obtained in the same manner as in Carrier Production Example 1, expect that the barium sulfate particles were replaced with alumina particles (circle-equivalent diameter: 600 nm).

Carrier Production Comparative Example 4

Carrier 17 of Carrier Production Comparative Example 4 was obtained in the same manner as in Carrier Production Example 1, expect that the barium sulfate particles were replaced with oxygen-deficient tin oxide-coated barium sulfate particles (circle-equivalent diameter: 400 nm), and the oxygen-deficient tin particles were not used.

Example 1

Production Example of Toner

—Synthesis of Polyester Resin A—

A reaction tank equipped with a cooling tube, a stirrer, and a nitrogen inlet tube was charged with 65 parts of a bisphenol A ethylene oxide (2 mol) adduct, 86 parts of a bisphenol A propylene oxide (3 mol) adduct, 274 parts of terephthalic acid, and 2 parts of dibutyltin oxide, and the resultant mixture was allowed to react for 15 hours at 230° C. under normal pressure. Subsequently, the resultant was allowed to react for 6 hours at from 5 mmHg through 10 mmHg, to thereby synthesize Polyester Resin A. The obtained Polyester Resin A was found to have a number average molecular weight (Mn) of 2,300, a weight average molecular weight (Mw) of 8,000, a glass transition temperature (Tg) of 58° C., an acid value of 25 mgKOH/g, and a hydroxyl value of 35 mgKOH/g.

—Synthesis of Styrene-Acryl Resin A—

A reaction tank equipped with a cooling tube, a stirrer, and a nitrogen inlet tube was charged with 300 parts of ethyl acetate, 185 parts of styrene, 115 parts of an acryl monomer, and 5 parts of azobisisobutyl nitrile. The resultant mixture was allowed to react for 8 hours in a nitrogen atmosphere at 65° C. (normal pressure). Subsequently, 200 parts of methanol was added to the reaction product, followed by stirring for 1 hour. Thereafter, the supernatant was removed, and the remaining product was dried under reduced pressure to thereby synthesize Styrene-Acryl Resin A. The obtained Styrene-Acryl Resin A was found to have a Mw of 20,000 and a Tg of 58° C.

—Synthesis of Prepolymer (Polymer Reactive with Active Hydrogen Group-Containing Compound)—

A reaction vessel equipped with a cooling tube, a stirrer, and a nitrogen inlet tube was charged with 682 parts of a bisphenol A ethylene oxide (2 mol) adduct, 81 parts of bisphenol A propylene oxide (2 mol) adduct, 283 parts of terephtalic acid, 22 parts of trimellitic anhydride, and 2 parts of dibutyltin oxide, and the resultant mixture was allowed to react for 8 hours at 230° C. under normal pressure. Subsequently, the resultant was allowed to react for 5 hours under a reduced pressure of from 10 mmHg through 15 mmHg, to thereby synthesize intermediate polyester.

The obtained intermediate polyester was found to have a number average molecular weight (Mn) of 2,100, a weight average molecular weight (Mw) of 9,600, a glass transition temperature (Tg) of 55° C., an acid value of 0.5, and a hydroxyl value of 49.

Subsequently, a reaction vessel equipped with a cooling tube, a stirrer, and a nitrogen inlet tube was charged with 411 parts of the intermediate polyester, 89 parts of isophorone diisocyanate, and 500 parts of ethyl acetate, and the resultant mixture was allowed to react for 5 hours at 100° C., to thereby synthesize a prepolymer (a polymer reactive with an active hydrogen group-containing compound).

An amount of free isocyanate in the obtained prepolymer was 1.60% by mass, and a solid content of the prepolymer (after being left to stand for 45 minutes at 150° C.) was 50% by mass.

—Synthesis of Ketimine (Active Hydrogen Group-Containing Compound)—

A reaction vessel equipped with a stirring bar and a thermometer was charged with 30 parts of isophorone diamine and 70 parts of methyl ethyl ketone, and the resultant mixture was allowed to react for 5 hours at 50° C., to thereby synthesize a ketamine compound (the active hydrogen group-containing compound). The obtained ketamine compound (the active hydrogen group-containing compound) was found to have an amine value of 423.

—Production of Master Batch—

By means of HENSCHEL MIXER (available from NIPPON COKE & ENGINEERING CO., LTD.), 1,000 parts of water, 540 parts of Printex 35, carbon black having a DBP oil absorption of 42 mL/100 g, and pH of 9.5 (available from Degussa AG), and 1,200 parts of Polyester Resin A were mixed. Subsequently, the obtained mixture was kneaded by means of a twin roll mill for 30 minutes at 150° C., followed by rolling and cooling the kneaded product. The resultant was pulverized by means of a pulverizer (available from HOSOKAWA MICRON CORPORATION), to thereby produce a master batch.

—Preparation of Aqueous Medium—

Ion-exchanged water (306 parts), 265 parts of a 10% by mass tricalcium phosphate suspension liquid, and 1.0 part of sodium dodecylbenzenesulfonate were mixed and stirred to be allowed to homogeneously dissolve, to thereby prepare an aqueous medium.

—Measurement of Critical Micelle Concentration—

A critical micelle concentration of the surfactant was measured by the following method. An analysis was performed by means of a surface tensiometer, Sigma (available from KSV Instruments) using an analysis program in the Sigma system. To the aqueous medium, a surfactant was added dropwise by 0.01% by mass. The resultant mixture was stirred, followed by being left to stand. Thereafter, a surface tension was measured. A concentration of the surfactant was calculated from the obtained surface tension curve as a critical micelle concentration at which the surface tension stopped decreasing even by dropwise addition of the surfactant. A critical micelle concentration of the sodium dodecylbenzenesulfonate in the aqueous medium was measured by the surface tensiometer, Sigma, and it was found that the critical micelle concentration thereof was 0.05% by mass relative to a mass of the aqueous medium.

—Preparation of Toner Material Liquid—

A beaker was charged with 70 parts of Polyester Resin A, 10 parts of the prepolymer, and 100 parts of ethyl acetate, and the resultant mixture was stirred to dissolve the resin and the prepolymer. To the resultant solution, 5 parts of a paraffin wax (HNP-9, available from NIPPON SEIRO CO., LTD., melting point: 75° C.) serving as a release agent, 2 parts of MEK-ST (available from NISSAN CHEMICAL INDUSTRIES, LTD.), and 10 parts of the master batch were added. The resultant mixture was allowed to pass through a bead mill, Ultraviscomill (available from Aimex Co., Ltd.) 3 times under the conditions that a feeding speed was 1 kg/hr, a rim speed of a disc was 6 m/sec, and a packed amount of zirconia beads having a particle diameter of 0.5 mm was 80% by volume. To the resultant, 2.7 parts of the ketimine compound was added and dissolved, to thereby prepare a toner material liquid.

—Preparation of Emulsion or Dispersion Liquid—

A vessel was charged with 150 parts of the aqueous medium, and the aqueous medium was stirred by means of a TK homomixer (available from Tokushu Kika Kogyo Co., Ltd.) at a rotational speed of 12,000 rpm. To the resultant, 100 parts of the toner material liquid was added. The resultant mixture was mixed for 10 minutes, to thereby prepare an emulsion or dispersion liquid (emulsified slurry).

—Removal of Organic Solvent—

A flask equipped with a stirrer and a thermometer was charged with 100 parts of the emulsified slurry, and the solvent in the emulsified slurry was removed for 12 hours at 30° C. under stirring at a stirring circumferential speed of 20 m/min to thereby obtain a dispersion slurry.

—Washing—

After filtration of 100 parts by mass of the dispersion slurry under reduced pressure, 100 parts of ion-exchanged water was added to the resultant filtration cake. The mixture was then mixed by means of a TK homomixer for 10 minutes at a rotational speed of 12,000 rpm, followed by filtration. To the obtained filtration cake, 300 parts of ion-exchanged water was added, and the resultant mixture was mixed by means of a TK homomixer for 10 minutes at a rotational speed of 12,000 rpm, followed by filtration. A series of the above addition of ion-exchanged water to the filtration cake, mixing, and filtration was performed twice in total. To the obtained filtration cake, 20 parts of a 10% by mass sodium hydroxide aqueous solution was added, and the resultant mixture was mixed by means of a TK homomixer for 30 minutes at a rotational speed of 12,000 rpm, followed by filtration under reduced pressure. To the obtained filtration cake, 300 parts of ion-exchanged water was added, and the resultant mixture was mixed by means of a TK homomixer for 10 minutes at a rotational speed of 12,000 rpm, followed by filtration. To the obtained filtration cake, 300 parts of ion-exchanged water was added, and the resultant mixture was mixed by means of a TK homomixer (for 10 minutes at a rotational speed of 12,000 rpm), followed by filtration. A series of the above addition of ion-exchanged water to the filtration cake, mixing, and filtration was performed twice in total. To the obtained filtration cake, 20 parts of 10% by mass hydrochloric acid was added, and the resultant mixture was mixed by means of a TK homomixer (for 10 minutes at a rotational speed of 12,000 rpm) followed by filtration.

—Adjustment of Amount of Surfactant—

To the filtration cake obtained from the aforementioned washing, 300 parts of ion-exchanged water was added. The resultant mixture was mixed by means of a TK homomixer (for 10 minutes at a rotational speed of 12,000 rpm) to prepare a toner dispersion liquid. Electrical conductivity of the toner dispersion liquid was measured, and a surfactant concentration in the toner dispersion liquid was calculated with reference to a surfactant concentration calibration curve, which had been prepared in advance. Based on the calculated value, ion-exchanged water was added to the toner dispersion liquid to adjust the surfactant concentration to a target surfactant concentration, i.e., 0.05% by mass, to thereby obtain a toner dispersion liquid.

—Surface Treatment—

While mixing the toner dispersion liquid, having a surfactant concentration adjusted to the predetermined value, by means of a TK homomixer at 5,000 rpm, heating was performed for 10 hours using a water bath with a heating temperature T1 of 55° C. Thereafter, the toner dispersion liquid was cooled to 25° C., followed by filtration. To the obtained filtration cake, 300 parts of ion-exchanged water was added. The resultant mixture was mixed by means of a TK homomixer (for 10 minutes at a rotational speed of 12,000 rpm), followed by filtration.

—Drying—

The obtained final filtration cake was dried by a circulating drier for 48 hours at 45° C. The dried product was sieved using a mesh having an opening size of 75 μm, to thereby obtain Toner Base Particles 1.

—External Additive Processing—

With 100 parts of Toner Base Particles 1, 3.0 parts of hydrophobic silica having an average particle diameter of 100 nm, 1.0 part of titanium oxide having an average particle diameter of 20 nm, 1.5 parts of a hydrophobic silica powder having an average particle diameter of 15 nm were mixed by means of HENSCHEL MIXER, to thereby obtain Toner 1.

<Production of Developer>

Carrier 1 (930 parts) obtained in Carrier Production Example 1 and Toner 1 (70 parts) were mixed. The resultant mixture was stirred by means of Turbula mixer for 5 minutes at 81 rpm, to thereby produce Developer 1 for an evaluation. Moreover, a supply developer was produced using the aforementioned carrier and the afore-mentioned toner in a manner that a toner concentration would be 95% by mass.

<Evaluations of Properties of Developer>

An image evaluation was performed using the obtained developer, and RICOH Pro C7110S available from Ricoh Company Limited (a digital color photocopier/printer multifunction peripheral, available from Ricoh Company Limited). Specifically, the aforementioned device was placed in an environment evaluation room (a low-temperature low-humidity environment of 10° C. and 15%) and left to stand for one day. Thereafter, an evaluation of an initial density variation (a density variation within a sheet) was performed using Developer 1 and Toner 1 of Example 1. The evaluation results of Example 1 are presented in Table 2-1.

—Initial Image—

<<Developing Performance>>

After outputting a solid image on 6,000 sheets available from Ricoh Company Limited, an image density of the image was measured by means of X-Rite (available from X-Rite Incorporated). The measurement was performed by outputting 1,000 sheets continuously, and measuring an image density of the image every 10 sheets. The lowest image density among the measured 100 sheets was taken as an evaluation result.

(Evaluation Criteria)

A: 1.5 or greater but less than 2.0

B: 1.3 or greater but less than 1.5

C: 1.2 or greater but less than 1.3

D: less than 1.2

<<Concentration Unevenness (Concentration Variation Within Sheet)>>

A solid image and a half-tone image were output and observed. Unevenness of the image was visually evaluated.

(Evaluation Criteria)

A: No concentration unevenness in the image at all.

B: A concentration unevenness was slightly observed in the image, but it was a level at which the unevenness would not cause a problem.

C: A concentration unevenness was noticeable in the image, and it was just a level at which the unevenness would not cause a problem.

D: A concentration unevenness was noticeable in the image, and it was a level at which the unevenness would cause a problem.

—Evaluation After Running of 1,000,000 Sheets with 40% Imaging Area Ratio—

A running evaluation was performed next. Developer 1 and Toner 1 of Example 1 were used in RICOH Pro C7110S available from Ricoh Company Limited (a digital color photocopier/printer multifunction peripheral available from Ricoh Company Limited). A charged amount of an initial carrier, and a charged amount of the carrier after running of the aforementioned device to output 1,000,000 sheet with an imaging area ratio of 40% were measured. A change in the charged amount was calculated. Moreover, toner scattering, background fog, a concentration unevenness (concentration variation within a sheet), and a concentration variation between sheets were evaluated after the running of the 1,000,000 sheets. The evaluation of the concentration unevenness (concentration variation within a sheet) was performed in the same manner as in the aforementioned method.

<<Charging Stability (Change in Charged Amount)>>

A charged amount (Q1) of an initial carrier was measured in the following manner. A sample was prepared by blending Carrier 1 and Toner 1 at a mass ratio of 93/7 (Carrier 1/Toner 1) to cause friction to thereby charge the carrier. The sample was measured by a blow-off static electrometer TB-200 (available from Toshiba Chemical Co., Ltd.). Moreover, a charged amount (Q2) of the carrier after the running of the 1,000,000 sheets was measured by means of the blow-off static electrometer in the same manner as in the aforementioned method, expect that the carrier which was separated from the toner of each color in the developer after the running was used. The change in the charged amount was determined by an absolute value of a value obtained from the following formula:

$$(Q1-Q2)/Q1\times100 \quad \text{[Math.2]}$$

Evaluation criteria are as follows.

(Evaluation Criteria)

A: 0 or greater but less than 5 (excellent)

B: 5 or greater but less than 10 (good)

C: 10 or greater but less than 20 (usable)

D: 20 or greater (poor)

<<Toner Scattering>>

After the running of the 1,000,000 sheets, an amount of the toner built up at the bottom of the developer bearing member was collected by suction, and a weight of the collected toner was measured. Evaluation criteria are as follows.

(Evaluation Criteria)

A: 0 mg or greater but less than 50 mg (excellent)

B: 50 mg or greater but less than 100 mg (good)

C: 100 mg or greater but less than 250 mg (usable)

D: 250 mg or greater (poor)

<<Background Fogging>>

After the running of the 1,000,000 sheets, an image forming process of a blank image was stopped during development. The toner on the photoconductor after the development was transferred to a tape. A difference (ΔID) between an image density of the tape, to which the toner had been transferred, and an image density of a tape, to which no toner had been transferred, was measured by 938 Spectrodensitometer (available from X-Rite Incorporated). Evaluation criteria are as follows.

(Evaluation Criteria)

A: 0 or greater but less than 0.005 (excellent)

B: 0.005 or greater but less than 0.01 (good)

C: 0.01 or greater but less than 0.02 (usable)

D: 0.02 or greater (poor)

<<Concentration Variation Between Sheets>>

After the running of the 1,000,000 sheets, a solid image having a size of A3 was continuously output on 100 sheets. The solid image on the first sheet, the solid image on the $50^{th}$ sheet, and the solid image on the $100^{th}$ sheet were measured by 938 Spectrodensitometer (available from X-Rite Incorporated). The measurement was performed on 6 positions in total per sheet (3 positions along a feeding direction×2 positions along a longitudinal direction). An average value of the measured values was taken as ID. A maximum value of differences between ID of the first sheet, ID of the $50^{th}$ sheet, and ID of the $100^{th}$ sheet was evaluated as ΔID Evaluation criteria are as follows.

(Evaluation Criteria)

A: 0 or greater but less than 0.05 (excellent)

B: 0.05 or greater but less than 0.1 (good)

C: 0.1 or greater but less than 0.2 (usable)

D: 0.2 or greater (poor)

—Evaluation After Running of 1,000,000 Sheets with 80% Imaging Area Ratio—

A running of 1,000,000 sheets was performed with an imaging area ratio of 80% by means of RICOH Pro C7110S available from Ricoh Company Limited (a digital color photocopier/printer multifunction peripheral available from Ricoh Company Limited). An evaluation was performed in the same manner as in the aforementioned evaluation.

—Evaluation After Running of 1,000,000 Sheets with 0.5% Imaging Area Ratio—

A running of 1,000,000 sheets was performed with an imaging area ratio of 0.5% by means of RICOH Pro C7110S available from Ricoh Company Limited (a digital color photocopier/printer multifunction peripheral available from Ricoh Company Limited) using Developer 1 and Toner 1 of Example 1. Stability of an amount of the developer, charging stability (a change in the charged amount), a concentration unevenness (concentration variation within a sheet), a concentration variation between sheets, solid carrier deposition, chargeability of a supplied toner, and easiness to mix the supplied toner were evaluated. The charging stability (the change in the charged amount), the concentration unevenness (the concentration variation within a sheet), and the concentration variation between sheets were evaluated by the same methods to the aforementioned methods. Other evaluations were performed based on the following evaluation criteria.

<<Stability of Amount of Developer>>

An amount of the developer passed through a developing doctor in the developing device was collected by a measuring jig (a jig capable of collecting 1 $cm^2$ of the developer), and a weight of the collected developer was measured. The measurement was performed on 3 positions of the developing sleeve along a longitudinal direction. An average value of the measured values was taken as an amount of the developer on the sleeve. The amount of the developer was measured at an initial stage, and after the running of the 1,000,000 sheets, and an absolute value of a difference in the amounts was evaluated. Evaluation criteria are as follows.

(Evaluation Criteria)

A: 0 mg or greater but less than 1 mg (excellent)

B: 1 mg or greater but less than 2 mg (good)

C: 2 mg or greater but less than 4 mg (usable)

D: 4 mg or greater (poor)

<<Solid Carrier Deposition>>

After the running of the 1,000,000 sheets, a solid image was formed under predetermined developing conditions (charging potential (Vd): minus 600 V, potential of an area corresponding to an image area (a solid image) after exposure: minus 100 V, developing bias: DC minus 500 V). During the image formation, the image formation was terminated by, for example, turning off a power, and the number of carrier particles deposited on the photoconductor, from which a toner image had been transferred, was counted, and evaluated. Note that, a region to be evaluated was a region having a size of 10 mm×100 mm on the photoconductor.

(Evaluation Criteria)

A: The number of carrier particles deposited was 0 (acceptable).

B: The number of carrier particles deposited was from 1 through 3 (acceptable).

C: The number of carrier particles deposited was from 4 through 10 (acceptable).

D: The number of carrier particles deposited was 11 or more (not acceptable).

<<Chargeability of Supplied Toner>>

After the running of the 1,000,000 sheets, a solid image was output on 1,000 sheets. Then, an amount of the toner build up at the bottom of the developer bearing member was collected by suction, and a weight of the collected toner was measured. Evaluation criteria are as follows.

(Evaluation Criteria)

A: 0 mg (excellent)

B: greater than 0 mg but less than 0.5 mg (good)

C: 0.5 mg or greater but less than 1 mg (usable)

D: 1 mg or greater (poor)

A, B, and C were acceptable, but D was not acceptable.

<<Easiness to Mix Supplied Toner>>

Easiness to mix a supplied toner was evaluated using the developer after the running of the 1,000,000 sheets, and the developing device of RICOH Pro C7110S. The developer after the running was placed in the developing device, and the developing device was driven as a single unit for 30 seconds at a rotational speed identical to that of RICOH Pro C7110S. Thereafter, the rotational speed was reduced to a half, and 1 g of the toner was supplied from a supply port. After stirring of the resultant for 3 seconds, a degree of mixing of the toner in the developer was evaluated. Evaluation criteria are as follows.

(Evaluation Criteria)

A: The added toner was completely mixed, and the resultant developer was uniform (excellent).

B: There was unevenness of the toner in part of the developer, but the resultant developer was mostly uniform (good).

C: There was significant unevenness of the toner in the developer, and the resultant developer was not uniform (usable).

D: There was the toner that had not been incorporated into the developer (poor).

A, B, and C were acceptable, but D was not acceptable. Note that, the present evaluation was related to the result of the aforementioned chargeability of the supplied toner.

Examples 2 to 13

Developers 2 to 13 of Examples 2 to 13 were evaluated in the same manner as in Example 1, expect that Carrier 1 was replaced with each of Carriers 2 to 13, and Developer 1 was replaced with each of Developers 2 to 13. The evaluation results of Examples 2 to 13 are presented in Tables 2-1 and 2-2.

Comparative Examples 1 to 4

Developers 14 to 17 of Comparative Examples 1 to 4 were evaluated in the same manner as in Example 1, expect that Carrier 1 was replaced with each of Carriers 14 to 17, and Developer 1 was replaced with each of Developers 14 to 17. The evaluation results of Comparative Examples 1 to 4 are presented in Table 2-3.

TABLE 1-1

| | Ex. 1 | Ex. 2 | Ex. 3 | Ex. 4 | Ex. 5 | Ex. 6 | Ex. 7 |
|---|---|---|---|---|---|---|---|
| Carrier No. | 1 | 2 | 3 | 4 | 5 | 6 | 7 |
| Developer No. | 1 | 2 | 3 | 4 | 5 | 6 | 7 |
| Type of Particles 1 | Ba sulfate | Ba sulfate | Ba sulfate | Ba sulfate | Ba sulfate | Ba sulfate | Ba sulfate |
| Amount of Particles 1 (to resin) | 90 | 90 | 90 | 90 | 50 | 100 | 40 |
| Circle equivalent diameter of Particles 1 (nm) | 700 | 900 | 400 | 600 | 700 | 700 | 700 |
| Height d of projected part of exposed area (nm) | 260 | 370 | 150 | 210 | 240 | 260 | 250 |
| Major axis of maximum exposed area (nm) | 480 | 610 | 270 | 370 | 420 | 470 | 400 |
| Type of Particles 2 | P-doped Sn | P-doped Sn | P-doped Sn | P-doped Sn | P-doped Sn | P-doped Sn | P-doped Sn |
| Amount of Particles 2 (to resin) | 150 | 150 | 150 | 150 | 150 | 150 | 150 |
| Ba value in XPS (atomic %) | 1.2 | 1.4 | 0.9 | 1.1 | 0.5 | 1.3 | 0.3 |
| Type of resin | R1 + Si | R1 + Si | R1 + Si | R1 + Si | R1 + Si | R1 + Si | R1 + Si |
| Film thickness of resin layer (μm) | 1.00 | 1.00 | 1.00 | 1.00 | 1.00 | 1.00 | 1.00 |

TABLE 1-2

| | Ex. 8 | Ex. 9 | Ex. 10 | Ex. 11 | Ex. 12 | Ex. 13 |
|---|---|---|---|---|---|---|
| Carrier No. | 8 | 9 | 10 | 11 | 12 | 13 |
| Developer No. | 8 | 9 | 10 | 11 | 12 | 13 |
| Type of Particles 1 | Ba sulfate | Ba sulfate | Ba sulfate | Ba sulfate | Ba sulfate | Ba sulfate |
| Amount of Particles 1 (to resin) | 50 | 90 | 90 | 90 | 90 | 90 |
| Circle equivalent diameter of Particles 1 (nm) | 600 | 700 | 700 | 700 | 700 | 700 |
| Heighd d of projected part in exposed area (nm) | 220 | 270 | 330 | 210 | 180 | 260 |
| Major diameter of maximum exposed area (nm) | 310 | 460 | 520 | 400 | 370 | 490 |
| Type of Particles 2 | P-doped Sn | P-doped Sn | P-doped Sn | P-doped Sn | P-doped Sn | none |
| Amount of Particles 2 (to resin) | 150 | 150 | 150 | 150 | 150 | 0 |

TABLE 1-2-continued

| | Ex. 8 | Ex. 9 | Ex. 10 | Ex. 11 | Ex. 12 | Ex. 13 |
|---|---|---|---|---|---|---|
| Ba value in XPS (atomic %) | 0.5 | 1.2 | 1.4 | 0.6 | 0.3 | 1.3 |
| Type of resin | R1 + Si | Si only | R1 + Si | R1 + Si | R1 + Si | R1 + Si |
| Film thickness of resin layer (μm) | 1.00 | 1.00 | 0.70 | 1.30 | 1.60 | 1.00 |

TABLE 1-3

| | Comp. Ex. 1 | Comp. Ex. 2 | Comp. Ex. 3 | Comp. Ex. 4 |
|---|---|---|---|---|
| Carrier No. | 14 | 15 | 16 | 17 |
| Developer No. | 14 | 15 | 16 | 17 |
| Type of Particles 1 | Ba sulfate | Ba sulfate | Alumina | Tin oxide-coated Ba sulfate |
| Amount of Particles 1 (to resin) | 90 | 90 | 90 | 90 |
| Circle equivalent diameter of Particles 1 (nm) | 1000 | 300 | 600 | 400 |
| Height d of projected part in exposed area (nm) | 420 | 130 | 220 | 30 |

TABLE 1-3-continued

| | Comp. Ex. 1 | Comp. Ex. 2 | Comp. Ex. 3 | Comp. Ex. 4 |
|---|---|---|---|---|
| Major axis of maximum exposed area (nm) | 620 | 200 | 350 | 100 |
| Type of Particles 2 | P-doped Sn | P-doped Sn | P-doped Sn | none |
| Amount of Particles 2 (to resin) | 150 | 150 | 150 | 0 |
| Ba value in XPS (atomic %) | 1.5 | 0.6 | 0.0 | 0.1 |
| Type of resin | R1 + Si | R1 + Si | R1 + Si | R1 + Si |
| Film thickness of resin layer (μm) | 1.00 | 1.00 | 1.00 | 1.00 |

TABLE 2-1

| | | Ex. 1 | Ex. 2 | Ex. 3 | Ex. 4 | Ex. 5 | Ex. 6 | Ex. 7 |
|---|---|---|---|---|---|---|---|---|
| | Carrier No. | 1 | 2 | 3 | 4 | 5 | 6 | 7 |
| | Developer No. | 1 | 2 | 3 | 4 | 5 | 6 | 7 |
| Initial image | Developing performance | A | A | A | A | A | C | A |
| | Concentration variation within sheet | A | B | A | A | A | C | A |
| After outputting 1 million sheets with imaging area ratio of 40% | Charge stability | A | A | B | A | B | A | B |
| | Toner scattering | A | A | B | A | B | A | B |
| | Background fogging | A | A | A | A | A | A | A |
| | Concentration variation within sheet | A | A | B | A | A | A | A |
| | Concentration variation between sheets | A | A | B | A | B | A | B |
| After outputting 1 million sheets with imaging area ratio of 80% | Charge stability | A | A | C | B | B | A | C |
| | Toner scattering | B | A | B | B | B | A | C |
| | Background fogging | A | A | B | A | A | A | B |
| | Concentration variation within sheet | A | B | B | A | B | A | B |
| | Concentration variation between sheets | B | A | C | B | B | B | B |
| After outputting 1 million sheets with imaging area ratio of 0.5% | Stability of developer amount | B | A | C | B | B | A | B |
| | Charge stability | A | B | A | A | B | B | B |
| | Concentration variation within sheet | A | A | A | A | A | B | A |
| | Concentration variation between sheets | A | B | B | A | A | B | A |
| | Solid carrier deposition | A | B | A | A | A | A | A |
| | Chargeability of supplied toner | A | A | C | B | C | A | C |
| | Easiness of mixing supply toner | A | A | C | B | B | A | C |

TABLE 2-2

| | | Ex. 8 | Ex. 9 | Ex. 10 | Ex. 11 | Ex. 12 | Ex. 13 |
|---|---|---|---|---|---|---|---|
| | Carrier No. | 8 | 9 | 10 | 11 | 12 | 13 |
| | Developer No. | 8 | 9 | 10 | 11 | 12 | 13 |
| Initial image | Developing performance | A | A | B | A | A | B |
| | Concentration variation within sheet | A | A | A | A | A | B |
| After outputting 1 million sheets with imaging area ratio of 40% | Charging stability | B | A | A | A | B | A |
| | Toner scattering | B | A | A | B | B | A |
| | Background fogging | A | A | A | A | B | A |
| | Concentration variation within sheet | A | A | A | A | B | A |
| | Concentration variation between sheets | B | A | A | B | B | A |
| After outputting 1 million sheets with imaging area ratio of 80% | Charging stability | B | B | A | B | C | A |
| | Toner scattering | B | B | B | B | C | B |
| | Background fogging | B | A | A | B | B | A |
| | Concentration variation within sheet | B | B | A | B | B | A |
| | Concentration variation between sheets | B | B | A | B | C | A |
| | Stability of developer amount | B | B | B | B | C | A |
| After outputting 1 million sheets with imaging area ratio of 0.5% | Charging stability | A | B | B | A | A | B |
| | Concentration variation within sheet | A | A | B | A | A | A |
| | Concentration variation between sheets | A | B | B | A | A | B |
| | Solid carrier deposition | A | C | C | A | A | A |
| | Chargeability of supplied toner | C | A | A | B | B | A |
| | Easiness of mixing supplied toner | C | B | A | B | C | A |

TABLE 2-3

| | | Comp. Ex. 1 | Comp. Ex. 2 | Comp. Ex. 3 | Comp. Ex. 4 |
|---|---|---|---|---|---|
| | Carrier No. | 14 | 15 | 16 | 17 |
| | Developer No. | 14 | 15 | 16 | 17 |
| Initial image | Developing performance | B | A | A | A |
| | Concentration variation within sheet | B | A | A | A |
| After outputting 1 million sheets with imaging area ratio of 40% | Charging stability | A | B | C | C |
| | Toner scattering | A | C | C | C |
| | Background fogging | A | B | B | C |
| | Concentration variation within sheet | A | B | B | B |
| | Concentration variation within sheet | A | B | B | B |
| After outputting 1 million sheets with imaging area ratio of 80% | Charging stability | A | D | D | D |
| | Toner scattering | A | D | D | D |
| | Background fogging | A | C | C | D |
| | Concentration variation within sheet | A | D | D | D |
| | Concentration variation within sheet | A | C | D | C |
| After outputting 1 million sheets with imaging area ratio of 0.5% | Stability of developer amount | C | D | B | B |
| | Charging stability | D | B | A | A |
| | Concentration variation within sheet | C | A | A | A |
| | Concentration variation within sheet | C | A | A | A |
| | Solid carrier deposition | D | A | A | A |

TABLE 2-3-continued

| | | Comp. Ex. 1 | Comp. Ex. 2 | Comp. Ex. 3 | Comp. Ex. 4 |
|---|---|---|---|---|---|
| | Chargeability of supplied toner | B | D | D | D |
| | Easiness of mixing supplied toner | A | C | D | D |

For example, the embodiments of the present invention are as follows.

<1> A carrier including a resin layer including at least one kind of particles, wherein the at least one kind of the particles are particles of barium sulfate, wherein an amount of Ba detected is 0.3 atomic % or greater in a Ba analysis through X-ray photoelectron spectroscopy (XPS) of the carrier, and wherein circle-equivalent diameters of the particles of the barium sulfate are 400 nm or greater but 900 nm or smaller.

<2> The carrier according to <1>, wherein Ba is present at surfaces of the particles of the barium sulfate.

<3> The carrier according to <1> or <2>, an amount of the particles of the barium sulfate in the resin layer is 50% by mass or greater but less than 100% by mass relative to a resin contained in the resin layer.

<4> The carrier according to any one of <1> to <3>, wherein a height d is 200 nm or greater, where the height d is a height of a projected part of the barium sulfate exposed from a surface of the resin layer of the carrier.

<5> The carrier according to any one of <1> to <4>, wherein a major axis of a maximum exposed area is 300 nm or greater, where the maximum exposed area is a maximum exposed area among exposed areas of the barium sulfate exposed from a surface of the resin layer of the carrier.

<6> The carrier according to any one of <1> to <5>, wherein a resin component of the resin layer contains a resin obtained by performing a heating process on a copolymer containing at least the following two monomer component A and monomer component B:

[Chem. 6]

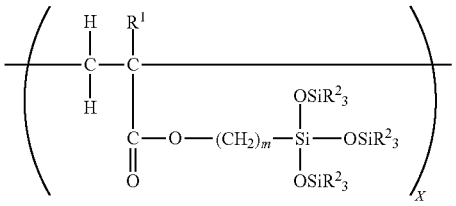

A Component

[Chem. 7]

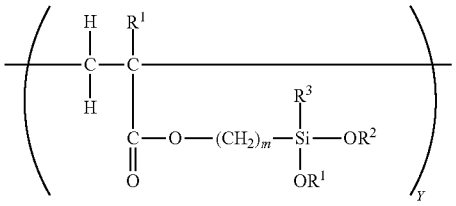

Component B (cross-linking component)

where $R^1$ is a hydrogen atom or a methyl group; m is an integer of from 1 through 8; $R^2$ is an alkyl group having from 1 through 4 carbon atoms; $R^3$ is an alkyl group from 1 through 8 carbon atoms or an alkoxy group having from 1 through 4 carbon atoms; X is from 10 mol % through 90 mol %; and Y is from 10 mol % through 90 mol %.

<7> The carrier according to <6>, wherein the resin component of the resin layer further contains the following monomer component C:

[Chem. 8]

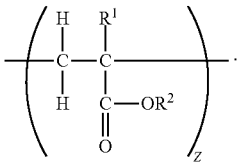

where $R^1$ is a hydrogen atom or a methyl group; $R^2$ is an alkyl group having from 1 through 4 carbon atoms; and Z is from 30 mol % through 80 mol %.

<8> The carrier according to <7>, wherein, as proportions of the monomer component A, the monomer component B, and the monomer component C, which are the resin components contained in the resin layer, X is from 10 mol % through 40 mol %, Y is from 10 mol % through 40 mol %, and Z is from 30 mol % through 80 mol %, and Y and Z satisfy the following relationship: 60 mol %<Y+Z<90 mol %.

<9> A developer including:

the carrier according to any one of <1> to <8>; and a toner.

<10> The developer according to <9>, wherein the toner is a color toner.

<11> The developer according to <9> or <10>, wherein the developer contains the toner in an amount of from 2 parts by mass to 50 parts by mass relative to 1 part by mass of the carrier, and the developer is used as a supply developer.

<12> An image forming apparatus including:

an electrostatic latent image bearer;

an electrostatic latent image forming unit configured to form an electrostatic latent image on the electrostatic latent image bearer; and a developing unit containing the developer and configured to develop the electrostatic latent image formed on the electrostatic latent image bearer with the developer according to any one of <9> to <11> to form a toner image.

<13> A developer stored unit including the developer according to any one of <9> to <11>, the developer being stored in the developer stored unit.

<14> An image forming method including:

forming an electrostatic latent image on an electrostatic latent image bearer; and developing the electrostatic latent image formed on the electrostatic latent image bearer with the developer according to any one of claims <9> to <11> to form a toner image.

The carrier according to any one of <1> to <8>, the developer according to any one of <9> to <11>, the image forming apparatus according to <12>, the developer stored unit according to <13>, and the image forming method according to <14> solve the aforementioned various problems in the art, and achieve the following object. Specifically, the object is to provide a carrier used in a developer that is used for an electrophotographic method or an electrostatic latent recording method, which can sufficiently control charge to achieve an image quality required in a production printing field, can supply a stable amount of the developer to a developing region, and continuous output of images with a low imaging area ratio can be realized with a high-speed device using a low-temperature fixing toner.

The invention claimed is:

1. A carrier, comprising a resin layer including at least one kind of particles, wherein the at least one kind of particles are particles of barium sulfate, an amount of Ba detected is 0.3 atomic % or greater in a Ba analysis through X-ray photoelectron spectroscopy of the carrier, and circle-equivalent diameters of the particles of barium sulfate range greater than 400 nm to 900 nm.

2. The carrier according to claim 1, wherein Ba is present at surfaces of the particles of barium sulfate.

3. The carrier according to claim 1, wherein an amount of the particles of barium sulfate in the resin layer is from 50% by mass to 100% by mass, relative to a resin contained in the resin layer.

4. The carrier according to claim 1, wherein a height d is 200 nm or greater, where the height d is a height of a projected part of barium sulfate exposed from a surface of the resin layer of the carrier.

5. The carrier according to claim 1, wherein a major axis of a maximum exposed area is 300 nm or greater, where the maximum exposed area is a maximum exposed area among exposed areas of barium sulfate exposed from a surface of the resin layer of the carrier.

6. The carrier according to claim 1, wherein a resin component of the resin layer contains a resin obtained by performing a heating process on a copolymer containing at least monomer component A, and monomer component B which is a cross-linking component, as shown below:

Component A

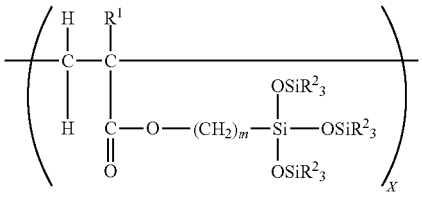

Component B

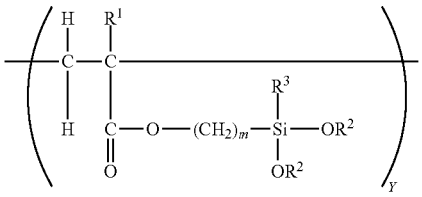

where $R^1$ is a hydrogen atom or a methyl group; in is an integer of from 1 through 8; $R^2$ is an alkyl group having from 1 through 4 carbon atoms; $R^3$ is an alkyl group having from 1 through 8 carbon atoms or an alkoxy group having from 1 through 4 carbon atoms; X is from 10 mol % through 90 mol %; and Y is from 10 mol % through 90 mol %.

7. A developer, comprising:

the carrier according to claim 1; and a toner.

8. The developer according to claim 7, wherein the toner is a color toner.

9. The developer according to claim 7, wherein the developer contains the toner in an amount of from 2 parts by mass to 50 parts by mass relative to 1 part by mass of the carrier, and the developer is used as a supply developer.

10. An image forming apparatus, comprising:

an electrostatic latent image bearer;

an electrostatic latent image forming unit configured to form an electrostatic latent image on the electrostatic latent image bearer; and a developing unit containing the developer according to claim 7 and configured to develop the electrostatic latent image formed on the electrostatic latent image bearer with the developer to form a toner image.

11. A developer stored unit, comprising the developer according to claim 7, wherein the developer is stored in the developer stored unit.

12. An image forming method, comprising:

forming an electrostatic latent image on an electrostatic latent image bearer; and developing the electrostatic latent image formed on the electrostatic latent image bearer with the developer according to claim 7 to form a toner image.

* * * * *